US011040535B2

(12) United States Patent
Tsukahara et al.

(10) Patent No.: US 11,040,535 B2
(45) Date of Patent: Jun. 22, 2021

(54) LIQUID EJECTING HEAD AND LIQUID EJECTING APPARATUS

(71) Applicant: SEIKO EPSON CORPORATION, Tokyo (JP)

(72) Inventors: Katsutomo Tsukahara, Shiojiri (JP); Shunsuke Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/803,643

(22) Filed: Feb. 27, 2020

(65) Prior Publication Data

US 2020/0269574 A1 Aug. 27, 2020

(30) Foreign Application Priority Data

Feb. 27, 2019 (JP) ..... JP2019-034133

(51) Int. Cl.
*B41J 2/14* (2006.01)

(52) U.S. Cl.
CPC ..... *B41J 2/1429* (2013.01); *B41J 2/1433* (2013.01); *B41J 2002/14467* (2013.01); *B41J 2002/14483* (2013.01)

(58) Field of Classification Search
CPC ..... B41J 2/1429; B41J 2/1433
See application file for complete search history.

(56) References Cited

U.S. PATENT DOCUMENTS 9,751,302 B1 * 9/2017 Nishimura ..... B41J 2/04525
2012/0176450 A1 7/2012 Akahane et al.
2013/0293065 A1 * 11/2013 Hajati ..... B06B 1/0629 310/334

FOREIGN PATENT DOCUMENTS

JP 2012-143948 8/2012

* cited by examiner

*Primary Examiner* — Lamson D Nguyen
(74) *Attorney, Agent, or Firm* — Workman Nydegger

(57) ABSTRACT

A liquid ejecting head includes: a flow channel forming substrate that forms an individual flow channel including a nozzle and a pressure chamber, a first common liquid chamber, and a second common liquid chamber; and a pressure generating element that causes a pressure change in a liquid in the pressure chamber, in which the first common liquid chamber is coupled to the second common liquid chamber via the individual flow channel, a compliance of the first common liquid chamber is larger than a compliance of the second common liquid chamber, and in the individual flow channel, a flow channel resistance between a first coupling portion with the first common liquid chamber and the pressure chamber is smaller than a flow channel resistance between a second coupling portion with the second common liquid chamber and the pressure chamber.

16 Claims, 8 Drawing Sheets

LIQUID EJECTING HEAD AND LIQUID EJECTING APPARATUS

The present application is based on, and claims priority from JP Application Serial Number 2019-034133, filed Feb. 27, 2019, the disclosure of which is hereby incorporated by reference herein in its entirety.

BACKGROUND

1. Technical Field

The present disclosure relates to a liquid ejecting head and a liquid ejecting apparatus.

2. Related Art

In the related art, an ink jet recording apparatus including a liquid ejecting head is known (for example, JP-A-2012-143948). In this ink jet recording apparatus, the liquid ejecting head has communication passages, a common liquid chamber as a first common liquid chamber that communicates in common with pressure generating chambers, and a circulation flow channel as a second common liquid chamber.

In the liquid ejecting head of the related art, when a pressure change occurs in the liquid in the pressure generating chamber, the liquid may flow into the common liquid chamber and the circulation flow channel from the pressure chamber. In such a case, with the inflow of the liquid, a pressure wave generated in the pressure generating chamber may be propagated to the common liquid chamber and the circulation flow channel, and may be further propagated to another pressure generating chamber that communicates with the common liquid chamber and the circulation flow channel. As described above, when vibration is propagated from one pressure generating chamber to the other pressure generating chamber, crosstalk may occur in which the amount of liquid droplets ejected from the liquid ejecting head becomes unstable. Therefore, in order to reduce the occurrence of crosstalk, it is necessary to improve the compliance of each of the common liquid chamber and the circulation flow channel depending on the amount of the liquid flowing in. The compliance is improved, for example, by increasing the volumes of the common liquid chamber and the circulation flow channel. However, when the volumes of the common liquid chamber and the circulation flow channel increase, the size of the liquid ejecting head may increase.

SUMMARY

According to an aspect of the present disclosure, a liquid ejecting head is provided. The liquid ejecting head includes: a flow channel forming substrate that forms an individual flow channel including a nozzle and a pressure chamber, a first common liquid chamber, and a second common liquid chamber; and a pressure generating element that causes a pressure change in a liquid in the pressure chamber, in which the first common liquid chamber is coupled to the second common liquid chamber via the individual flow channel, a compliance of the first common liquid chamber is larger than a compliance of the second common liquid chamber, and in the individual flow channel, a flow channel resistance between a first coupling portion with the first common liquid chamber and the pressure chamber is smaller than a flow channel resistance between a second coupling portion with the second common liquid chamber and the pressure chamber.

DESCRIPTION OF EXEMPLARY EMBODIMENTS

A. First Embodiment

Figure 1:
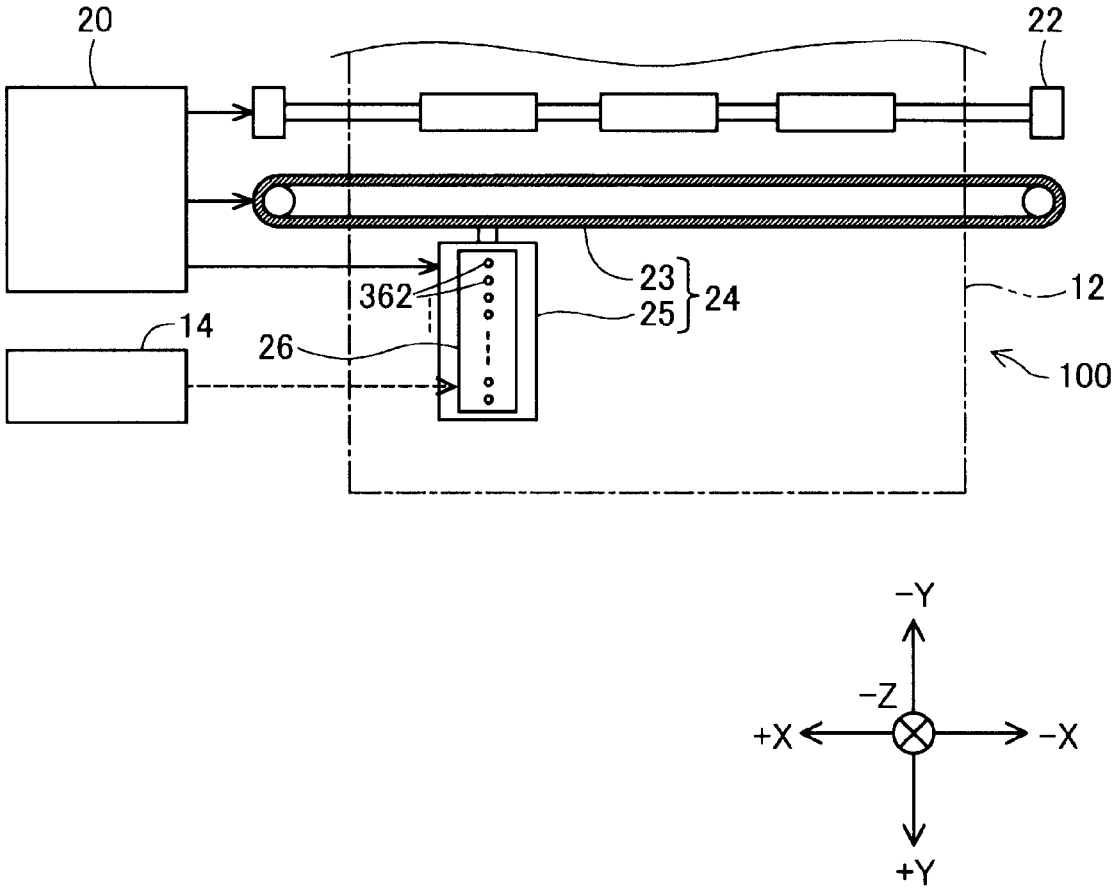
FIG. 1 is a diagram schematically illustrating a configuration of a liquid ejecting apparatus according to an embodiment of the present disclosure.

FIG. 1 is a diagram schematically illustrating a configuration of a liquid ejecting apparatus 100 according to an embodiment of the present disclosure. The liquid ejecting apparatus 100 is an ink jet printing apparatus that ejects an ink, which is an example of a liquid, onto a medium 12. The liquid ejecting apparatus 100 sets, as the medium 12, a printing target made of a predetermined material such as a resin film and a cloth in addition to a printing paper sheet, and performs printing by ejecting the liquid onto these various types of media 12. In an X direction, a Y direction, and a Z direction perpendicular to each other, in each drawing after FIG. 1, a main scanning direction that is a movement direction of a liquid ejecting head 26, which will be described below, is set as the X direction, a sub scanning direction that is a medium feeding direction perpendicular to the main scanning direction is set as the Y direction, and an ink ejecting direction is set as the Z direction. Further, when a direction is specified, a positive direction is set as "+" and a negative direction is set as "−". In this case, both positive and negative signs are used for direction indication. The liquid ejecting head 26 may not move in the X direction or the liquid ejecting head 26 may move relative to the medium 12 in the Y direction.

The liquid ejecting apparatus 100 includes a liquid storage container 14, a transport mechanism 22 that sends out the medium 12, a control unit 20, a head movement mechanism 24, and the liquid ejecting head 26. The liquid storage container 14 stores the ink supplied to the liquid ejecting head 26. A bag-like ink pack formed of a flexible film, an ink tank that can be refilled with the ink or the like can be used as the liquid storage container 14. The control unit 20 includes a processing circuit such as a central processing unit (CPU) and a storage circuit such as a semiconductor memory, and comprehensively controls the transport mechanism 22, the head movement mechanism 24, the liquid ejecting head 26, and the like. The transport mechanism 22 is operated under a control of the control unit 20, and sends out the medium 12 in the +Y direction.

The head movement mechanism 24 includes a transport belt 23 bridged in the X direction over a printing range of the medium 12 and a carriage 25 in which the liquid ejecting head 26 is stored and which is fixed to the transport belt 23. The head movement mechanism 24 is operated under the control of the control unit 20, and causes the carriage 25 to reciprocate in the X direction that is the main scanning direction of the liquid ejecting head 26. When the carriage 25 reciprocates, the carriage 25 is guided by a guide rail that is not illustrated. The liquid ejecting head 26 has a plurality of nozzles 362 arranged in the Y direction that is the sub scanning direction. A head configuration in which a plurality of the liquid ejecting heads 26 are mounted on the carriage 25 or a head configuration in which the liquid storage container 14 together with the liquid ejecting head 26 is mounted on the carriage 25 may be employed.

Figure 2:
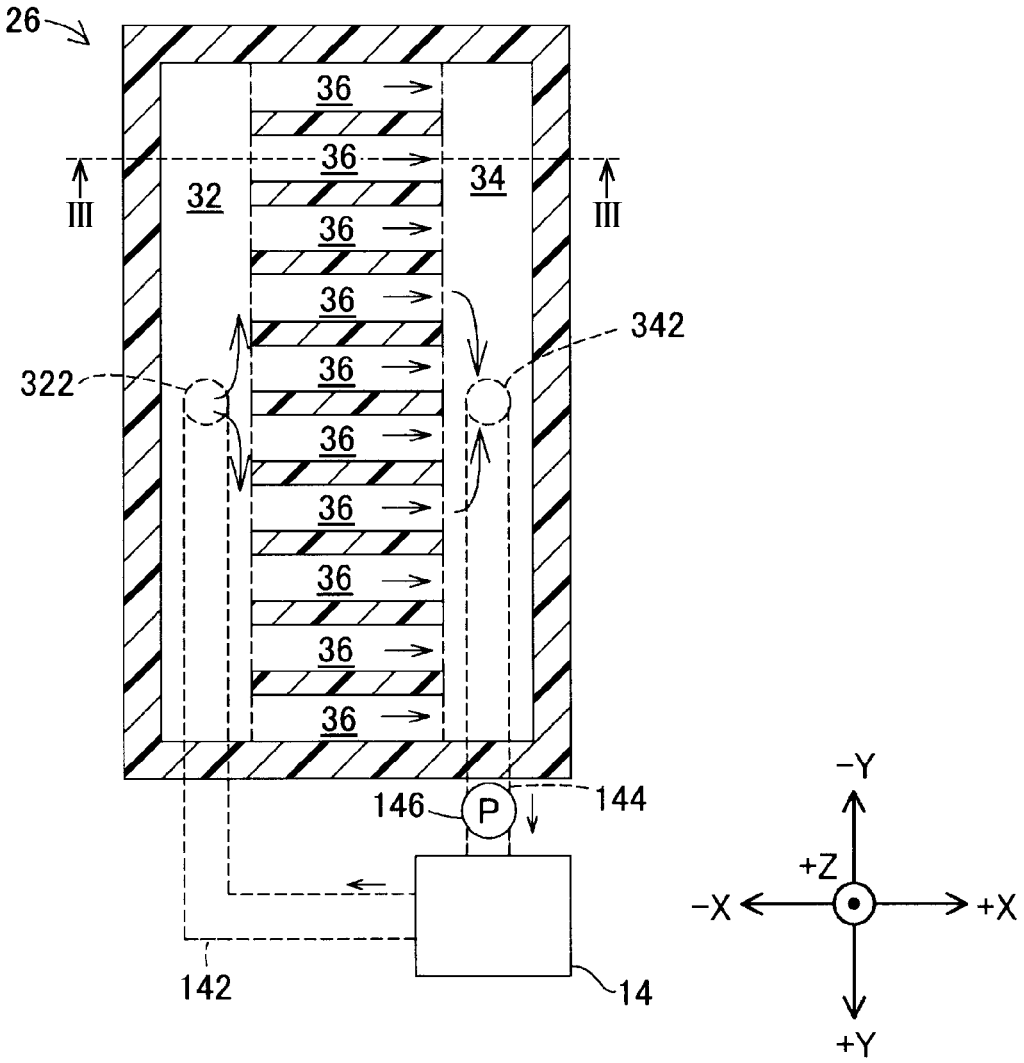
FIG. 2 is a schematic sectional view of the liquid ejecting head in an XY plane.

FIG. 2 is a schematic sectional view of the liquid ejecting head 26 in an XY plane. The liquid ejecting head 26 includes a flow channel formation substrate at which a plurality of individual flow channels 36, one first common liquid chamber 32, and one second common liquid chamber 34 are formed. The first common liquid chamber 32 and the second common liquid chamber 34 are coupled to communicate with each other via the plurality of individual flow channels 36.

The liquid storage container 14 and the liquid ejecting head 26 are coupled to each other via a supply flow channel 142 and a recovery flow channel 144 in a state in which the liquid can circulate. The supply flow channel 142 is coupled to a supply port 322 formed in the first common liquid chamber 32 of the liquid ejecting head 26. The recovery flow channel 144 is coupled to a discharge port 342 formed in the second common liquid chamber 34 of the liquid ejecting head 26. The recovery flow channel 144 is provided with a pump 146. The pump 146 sends out the liquid from the liquid ejecting head 26 side to the liquid storage container 14 side, and causes the liquid to circulate between the liquid ejecting head 26 and the liquid storage container 14. The supply flow channel 142 may be provided with a pump.

The liquid in the liquid ejecting head 26 circulates through the following path. The liquid supplied from the liquid storage container 14 via the supply flow channel 142 first flows into the first common liquid chamber 32. The liquid that has flowed into the first common liquid chamber 32 flows into each of the plurality of individual flow channels 36 coupled to the first common liquid chamber 32. The liquid that has flowed into the plurality of individual flow channels 36 flows into the second common liquid chamber 34 that is commonly coupled to the plurality of individual flow channels 36. The liquid in the second common liquid chamber 34 is recovered into the liquid storage container 14 via the recovery flow channel 144. The liquid recovered in the liquid storage container 14 is supplied to the liquid ejecting head 26 via the supply flow channel 142 again.

Figure 3:
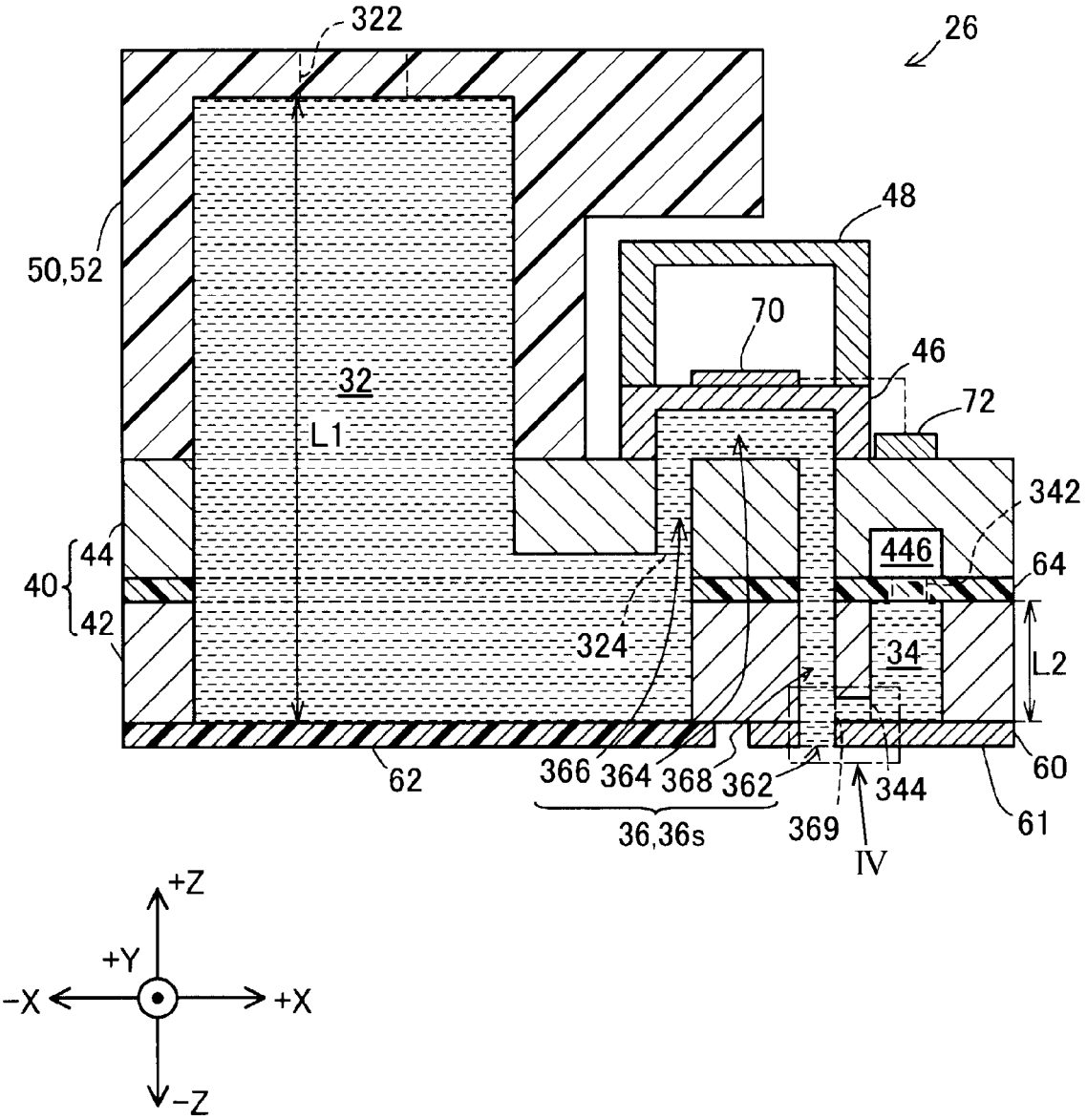
FIG. 3 is a schematic sectional view of the liquid ejecting head, which is taken along line III-III of FIG. 2.

FIG. 3 is a schematic sectional view of the liquid ejecting head 26, which is taken along line III-III of FIG. 2. As described above, the liquid ejecting head 26 includes, as a flow channel structure, the first common liquid chamber 32, the second common liquid chamber 34, and the individual flow channels 36. In FIG. 3, although only one individual flow channel 36 is illustrated, the plurality of individual flow channels 36 are arranged in the Y direction that is a depth direction of the figure. Further, the first common liquid chamber 32 and the second common liquid chamber 34 are commonly coupled to the plurality of individual flow channels 36. Therefore, the depth of the first common liquid chamber 32 and the second common liquid chamber 34, the dimension in the Y direction in FIG. 3, is larger than the depth of each individual flow channel 36. Hereinafter, the plurality of individual flow channels 36 arranged in the Y direction are also referred to as an individual flow channel group 36*s*.

The first common liquid chamber 32 has a larger volume than that of the second common liquid chamber 34. A first dimension L1 that is a dimension of the first common liquid chamber 32 in the Z direction is larger than a second dimension L2 that is a dimension of the second common liquid chamber 34 in the Z direction. In the present embodiment, the first dimension L1 is equal to or larger than three times the second dimension L2. Accordingly, it is easy to increase the volume of the first common liquid chamber 32. In the present embodiment, the second dimension L2 is 1 mm or less.

Each of the plurality of individual flow channels 36 has the nozzle 362 having an opening for ejecting the liquid and a pressure chamber 364. A pressure is applied to the liquid in the individual flow channels 36 in the pressure chamber 364. A part of the liquid to which the pressure is applied is ejected from the nozzle 362. Further, a part of the liquid that has not been ejected from the nozzle 362 moves to the first common liquid chamber 32 and the second common liquid chamber 34 coupled to the individual flow channels 36. At this time, vibration generated in the pressure chamber 364 when the pressure is applied propagates, as residual vibration, to the first common liquid chamber 32 and the second common liquid chamber 34 together with inflow of the liquid. Accordingly, residual vibration generated in the individual flow channel 36 by itself is reduced. When the pressure is applied in the pressure chamber 364, a pressure generating element 70 may be driven to eject the liquid from the nozzle 362 or the pressure generating element 70 may be driven to oscillate the meniscus of the nozzle 362 to the extent that the liquid is not ejected from the nozzle 362.

The individual flow channel 36 has a first coupling portion 324 that is a coupling portion between the individual flow channel 36 and the first common liquid chamber 32 and a second coupling portion 344 that is a coupling portion between the individual flow channel 36 and the second common liquid chamber 34. The individual flow channel 36 has a first coupling flow channel 366, the pressure chamber 364, a second coupling flow channel 368, and the nozzle 362. The first coupling flow channel 366 is a flow channel coupling the first coupling portion 324 and the pressure chamber 364 and extending in the Z direction. The second coupling flow channel 368 is configured with a flow channel coupling the second coupling portion 344 and the nozzle 362 and extending in the X direction and a flow channel coupling the nozzle 362 and the pressure chamber 364 and extending in the Z direction. The pressure chamber 364 is a space located between the first coupling flow channel 366 and the second coupling flow channel 368 and is a space provided to correspond to the pressure generating element 70.

The liquid ejecting head 26 includes a first communication plate 42, a second communication plate 44, a case 52, and a pressure chamber forming substrate 46, as a flow channel forming substrate of a member that forms a flow channel structure. In the liquid ejecting head 26, the first communication plate 42, the second communication plate 44, and the case 52 are stacked in the order thereof from the −Z direction to the +Z direction. Further, the second communication plate 44 and the pressure chamber forming substrate 46 are stacked in the order thereof from the −Z direction to the +Z direction. The first communication plate 42 and the second communication plate 44 are plate-like members extending in the XY plane, respectively. The first communication plate 42 and the second communication plate 44 correspond to a first flow channel substrate 40 formed of the same material. The case 52 corresponds to a second flow channel substrate 50 formed of a material that is different from that of the first flow channel substrate 40. As the second flow channel substrate 50 and the first flow channel substrate 40 are formed of different materials, for example, the first flow channel substrate 40 can be formed of a silicon single crystal plate that can be processed with high accuracy, and the second flow channel forming member can be formed of a resin molded product that can be molded at low costs. Accordingly, the degree of freedom of design in the liquid ejecting head 26 is improved. The second flow channel substrate 50 and the first flow channel substrate 40 may be formed of the same material.

The first communication plate 42 is formed of a silicon single crystal substrate, and has a plurality of opening portions penetrated from one surface on the −Z direction side to the other surface on the +Z direction side. A part of the first common liquid chamber 32, the second common liquid chamber 34, and a part of the individual flow channel 36 are formed by the opening portions of the first communication plate 42, respectively. A first film 62 and a nozzle plate 60 are attached to the opening portion of the first communication plate 42 on the −Z direction side. The first communication plate 42 may be formed of a material other than the silicon single crystal plate, for example, any of various materials such as metal, resin, and glass.

The second communication plate 44 is attached to the first communication plate 42 from the −Z direction side via a second film 64. Similar to the first communication plate 42, the second communication plate 44 is formed of a silicon single crystal plate, and has a plurality of opening portions penetrated from one surface on the −Z direction side to the other surface on the +Z direction side. Further, the second communication plate 44 has a recess portion 446 that is open on the −Z direction side in addition to the opening portions that form parts of the first common liquid chamber 32 and the individual flow channel 36. The opening portions formed in the second communication plate 44 are formed with a part of the first common liquid chamber 32 and a part of the individual flow channel group 36*s*. The recess portion 446 is formed at a position overlapping the second common liquid chamber 34 formed by the first communication plate 42 in the Z direction. The case 52 and the pressure chamber forming substrate 46 are attached to each other on the +Z direction side of the second communication plate 44. The second communication plate 44 may be formed of a material other than the silicon single crystal plate, for example, any of various materials such as metal, resin, and glass.

The first film 62 is attached to the first communication plate 42 from the −Z direction side to cover the opening portion that forms the first common liquid chamber 32 among the opening portions of the first communication plate 42. The first film 62 is a film member formed of a flexible resin. The first film 62 may be made of a material other than resin, for example, any of various materials such as thin film metal.

The nozzle plate 60 is attached to the first communication plate 42 from the −Z direction side to cover the opening portion that forms the second common liquid chamber 34 and the opening portion that forms the individual flow channel group 36*s* among the opening portions of the first communication plate 42. The nozzle plate 60 is a plate-like member formed of a silicon single crystal plate and having rigidity. The nozzle plate 60 has a nozzle opening at a position that overlaps each of the individual flow channels 36 defined by the first communication plate 42 in the Z direction. The nozzle 362 is formed in each of the plurality of individual flow channels 36 by the nozzle opening. The nozzle plate 60 may be formed of a material other than the silicon single crystal plate, for example, any of various materials such as metal, resin, and glass.

Similar to the first film 62, the second film 64 is a flexible film member. The second film 64 has openings at a position overlapping the first common liquid chamber 32 and a position overlapping each of the plurality of individual flow channels 36. Accordingly, the openings formed in the first communication plate 42 and the second communication plate 44 communicate with each other. The second film 64 may be made of a material other than resin, for example, any of various materials such as thin film metal.

The second film 64 does not have an opening between the second common liquid chamber 34 defined by the first communication plate 42 and the recess portion 446 formed in the second communication plate 44. Therefore, the second film 64 partitions the second common liquid chamber 34 and the recess portion 446 in a state in which the second common liquid chamber 34 and the recess portion 446 do not communicate with each other.

The case 52, which is a second flow channel forming member, is formed of a resin molded product such as plastic, which is unlike the first communication plate 42 and the second communication plate 44. The case 52 has a recess portion at a position overlapping, in the Z direction, the opening that forms a part of the first common liquid chamber 32 among the opening portions formed in the first communication plate 42 and the second communication plate 44. The recess portion formed in the case 52 is open on the −Z direction side to which the second communication plate 44 is coupled. Further, except for the supply port 322, the +Z direction side is closed. The case 52 forms the first common liquid chamber 32 together with the first communication plate 42 and the second communication plate 44. The supply port 322 is formed at a surface of the recess portion of the case 52 on the +Z direction side. The case 52 may be formed of a material other than plastic, for example, any of various materials such as a silicon single crystal plate and metal.

The pressure chamber forming substrate 46 is formed of a silicon single crystal plate. The pressure chamber forming substrate 46 has a plurality of recess portions at positions overlapping, in the Z direction, the openings that form some of the plurality of individual flow channels 36 among the opening portions formed in the first communication plate 42 and the second communication plate 44. The recess portion formed in the pressure chamber forming substrate 46 is open on the −Z direction side to which the second communication plate 44 is coupled, and is closed on the +Z direction side. Each of the plurality of recess portions of the pressure chamber forming substrate 46 forms the pressure chamber 364 in the individual flow channel 36. The pressure chamber forming substrate 46 may be formed of a material other than the silicon single crystal plate, for example, any of various materials such as metal, resin, and glass.

The pressure generating element 70 for causing a pressure change in the liquid in the pressure chamber 364 is disposed on the +Z direction side of the pressure chamber forming substrate 46 while being covered with a protective substrate 48. That is, a space in which a pressure change is generated by driving the pressure generating element 70 becomes the pressure chamber 364. In the present embodiment, a piezoelectric element is used as the pressure generating element 70. The pressure generating element 70 is electrically coupled to an electrode 72. The electrode 72 is electrically coupled to a flexible cable, a bump, or the like that is not illustrated. In the present embodiment, the liquid ejecting apparatus 100 is a piezo ink jet printer in which a piezoelectric actuator that is a piezoelectric element is employed as a pressure generating element. However, the present disclosure is not limited thereto. For example, the liquid ejecting apparatus 100 may be a thermal ink jet printer that includes, instead of the piezoelectric element, the pressure generating element that changes the pressure in the pressure chamber 364 by heating the liquid in the pressure chamber 364.

The electrode 72 is disposed at a position overlapping the second common liquid chamber 34 in the Z direction. Accordingly, as compared with a case where the electrode 72 is arranged in a position overlapping the first common liquid chamber 32 in the Z direction, the dimension of the first common liquid chamber 32 in the Z direction easily increases. Further, as the electrode 72 is disposed on the +Z direction side of the second common liquid chamber 34 having a relatively small dimension in the Z direction, the liquid ejecting head 26 is easily downsized in the Z direction.

As described above, the first common liquid chamber 32 is formed with the first communication plate 42 and the second communication plate 44 that are the first flow channel substrate 40 and the case 52 that is the second flow channel substrate 50. Further, the bottom surface of the first common liquid chamber 32 is defined by the flexible first film 62. Accordingly, the compliance of the first common liquid chamber 32 is improved. Further, since a part of the first common liquid chamber 32 is defined by the case 52 formed of plastic, costs for increasing the volume of the first common liquid chamber 32 are reduced. Further, a portion of the first common liquid chamber 32, which has the first coupling portion 324 with the individual flow channel 36, is formed with the second communication plate 44 formed of a silicon single crystal plate that can be processed with high accuracy. Therefore, for example, the opening area of the first coupling portion 324 can be adjusted with high accuracy during a manufacturing process.

The second common liquid chamber 34 is formed with the first communication plate 42 that is the first flow channel substrate 40. The bottom surface of the second common liquid chamber 34 is defined by the nozzle plate 60. The top surface of the second common liquid chamber 34 is defined by the second film 64.

The recess portion 446 is formed at an opposite side of the second common liquid chamber 34 with the second film 64 in between. Therefore, an area of the second film 64, which defines the top surface of the second common liquid chamber 34, can be deformed in the Z direction. Accordingly, the compliance of the second common liquid chamber 34 is improved.

The second common liquid chamber 34 is formed with the first communication plate 42 formed of a silicon single crystal plate that can be processed with high accuracy. Therefore, for example, the size of the second common liquid chamber 34 can be adjusted with high accuracy during a manufacturing process. Further, for example, the opening area of the second coupling portion 344 can be adjusted with high accuracy.

The individual flow channel group **36*s* is formed with the first communication plate 42 and the second communication plate 44 that are the first flow channel substrate 40 and the pressure chamber forming substrate 46. In detail, the second coupling flow channel 368 extending from the first coupling portion 324 toward the pressure chamber 364 and the first coupling flow channel 366 extending from the second coupling portion 344 toward the pressure chamber 364 in the individual flow channel 36 are formed with the first flow channel substrate 40. Further, the pressure chamber 364 in the individual flow channel 36 is formed with the pressure chamber forming substrate 46. The individual flow channel 36 is formed with the first flow channel substrate 40 and the pressure chamber forming substrate 46 formed of a silicon single crystal plate that can be processed with high accuracy. Therefore, for example, the flow channel shape of the individual flow channel 36** can be adjusted with high accuracy during a manufacturing process.

The nozzle plate 60 defines the nozzle surface 61 of the liquid ejecting head 26. The nozzle surface 61 is a wall surface that is opposite to the bottom surface of the second common liquid chamber 34 in the nozzle plate 60. Further, the nozzle surface 61 is a wall surface on which the nozzle 362 is formed at the outer wall surface of the liquid ejecting head 26. In the present embodiment, the nozzle surface 61 extends along a direction perpendicular to the Z direction, that is, the XY plane.

The first common liquid chamber 32 has an internal space extending both on the +Z direction side from the pressure generating element 70 and on the −Z direction side from the pressure generating element 70. On the other hand, the second common liquid chamber 34 has an internal space extending only on the −Z direction side from the pressure generating element 70. Therefore, it is easy to increase the volume of the first common liquid chamber 32.

The first common liquid chamber 32 and the second common liquid chamber 34 communicating with the individual flow channel group **36*s* are configured to have the compliance that can reduce the occurrence of crosstalk. The crosstalk refers to a phenomenon in which vibration generated from the pressure generating element 70 attached to one individual flow channel 36 among the plurality of individual flow channels 36 affects other individual flow channels 36. With the above configuration, even when the vibration is propagated to the first common liquid chamber 32 and the second common liquid chamber 34 together with the inflow of the liquid from the individual flow channels 36, the first common liquid chamber 32 and the second common liquid chamber 34 can reduce residual vibration. Therefore, further propagation of the residual vibration propagated to the first common liquid chamber 32 from the first common liquid chamber 32 side to the individual flow channels 36 can be reduced. Therefore, further propagation of the residual vibration propagated to the second common liquid chamber 34 from the second common liquid chamber 34 side to the individual flow channels 36** can be reduced.

The compliance capabilities of the first common liquid chamber 32 and the second common liquid chamber 34 are changed depending on the volume of the liquid, the propagation speed of a sound wave in the liquid, the tensile force of the first film 62 or the second film 64, and the area of the first film 62 or the second film 64. For example, as the volume of the liquid becomes larger, the compliance becomes larger. Further, the compliance becomes larger as the flexible wall surface of the common liquid chamber, that is, the area of the first film 62 or the second film 64, becomes larger. Here, the first common liquid chamber 32 has a volume that is larger than that of the second common liquid chamber 34. Further, the first film 62 has an area that is larger than the second film 64. Accordingly, the compliance of the first common liquid chamber 32 is larger than the compliance of the second common liquid chamber 34. In this case, it is preferable that the compliance of the first common liquid chamber 32 is larger than 1.5 times the compliance of the second common liquid chamber 34, and it is more preferable that the compliance of the first common liquid chamber 32 is larger than 2 times the compliance of the second common liquid chamber 34. Therefore, even when a larger amount of the liquid flows in the first common liquid chamber 32 than in the second common liquid chamber 34, the residual vibration can be further reduced, so that the occurrence of the crosstalk can be reduced.

As the compliance of the first common liquid chamber 32 is larger than the compliance of the second common liquid chamber 34 as described above, the occurrence of crosstalk can be reduced even when a large amount of the liquid flows into the first common liquid chamber 32. Thus, in the present embodiment, the plurality of individual flow channels 36 are configured such that the flow channel resistance of the first coupling flow channel 366 between the first coupling portion 324 and the pressure chamber 364 becomes smaller than the flow channel resistance of the second coupling flow channel 368 between the second coupling portion 344 and the pressure chamber 364. Therefore, when a pressure change in the liquid in the pressure chamber 364 occurs, a large amount of the liquid can flows into the first common liquid chamber 32 having a relatively large compliance. Further, a possibility that the amount of the liquid exceeding the compliance flows into the second common liquid chamber 34 having a relatively small compliance can be reduced. The flow channel resistance depends on a flow channel structure such as a flow channel length and a flow channel cross-section. The magnitude of the flow channel resistance can be compared using the pressure loss in the liquid. For example, in the case of a linear flow channel having the same flow channel cross-section, as the flow channel length of the first coupling flow channel 366 is made shorter than the flow channel length of the second coupling flow channel 368, the magnitude relationship between the flow channel resistances described above is generated.

Further, in the plurality of individual flow channels 36, the inertance between the first coupling portion 324 and the pressure chamber 364, that is, of the first coupling flow channel 366, is smaller than the inertance between the second coupling portion 344 and the pressure chamber 364, that is, of the second coupling flow channel 368. The inertance is a parameter that determines easiness of instantaneous flow of the liquid. That is, although the easiness of movement of the liquid in the flow channel is described and is expressed as mass in the laws of motion, the equivalent mass when the easiness of movement of the liquid in the flow channel is applied to flow in a pipeline is the inertance. When a pressure change in the liquid in the pressure chamber 364 occurs, a large amount of the liquid can flows into the first common liquid chamber 32 having a relatively large compliance. Further, a possibility that the amount of the liquid exceeding the compliance flows into the second common liquid chamber 34 having a relatively small compliance can be reduced. The inertance depends on a flow channel structure such as a flow channel length and a flow channel cross-section.

Figure 4:
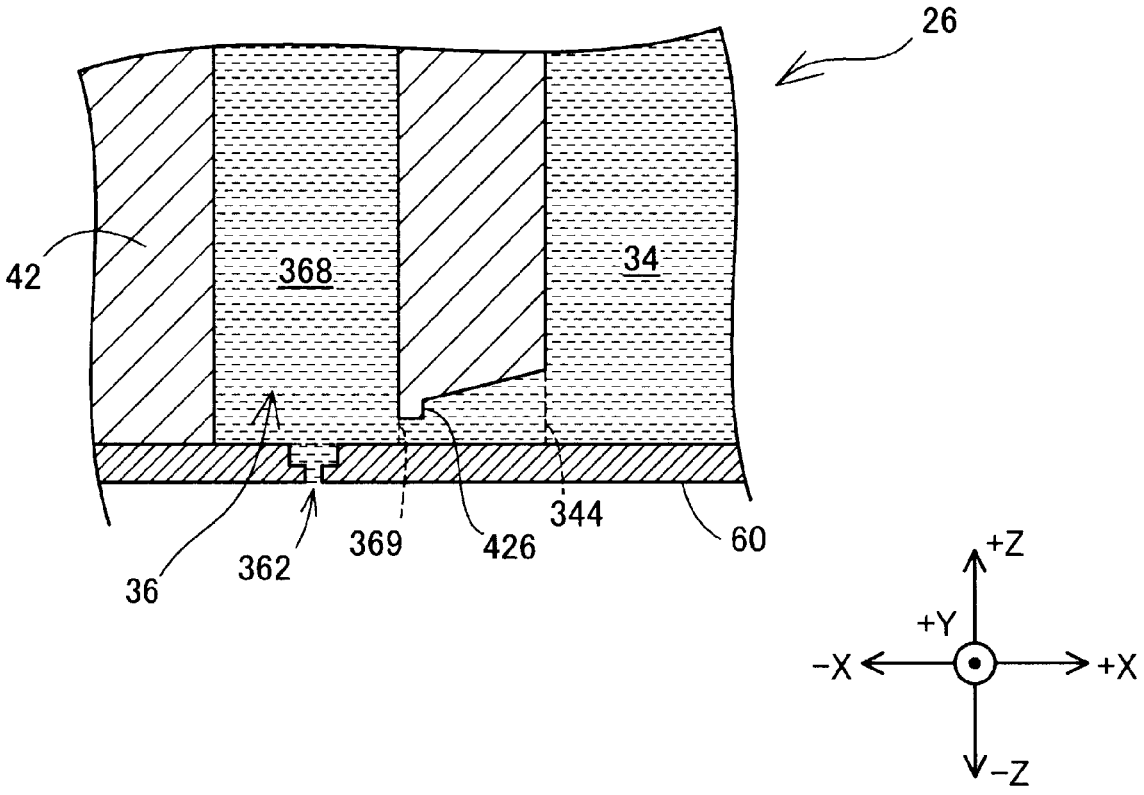
FIG. 4 is an enlarged view of a flow channel structure in an area 4 of FIG. 3 as indicated by a one-dot chain line.

FIG. 4 is an enlarged view of a flow channel structure in an area 4 of FIG. 3 as indicated by a one-dot chain line. The second coupling flow channel 368 in the individual flow channel 36 is provided with a partition wall 426 that reduces the flow channel cross-sectional area of the individual flow channel 36. The partition wall 426 is provided on the second coupling portion 344 side from the nozzle 362 among the second coupling flow channel 368. In more detail, the partition wall 426 is provided between a branching point 369 and the second coupling portion 344. The branching point 369 is a position where a flow channel extending from the nozzle 362 toward the pressure chamber 364 and a flow channel extending from the nozzle 362 toward the second common liquid chamber 34 are branched in the individual flow channel 36. That is, the individual flow channel 36 branches off to the second coupling portion 344 and the nozzle 362 at the branching point 369 between the pressure chamber 364 and the second coupling portion 344.

As the partition wall 426 is provided in the individual flow channel 36, the inertance from the branching point 369 to the second coupling portion 344 increases. Further, the inertance of the first coupling flow channel 366 is smaller than the inertance of the second coupling flow channel 368 provided with the partition wall 426 on the second coupling portion 344 side from the branching point 369. Accordingly, the inertance of the first coupling flow channel 366 is larger than the inertance of the second coupling flow channel 368 without increasing the inertance from the pressure chamber 364 to the nozzle 362. Therefore, the liquid can smoothly move from the pressure chamber 364 to the nozzle 362, so that the liquid can be efficiently ejected from the nozzle 362 based on the pressure change generated by the pressure generating element 70. That is, liquid ejection efficiency of the liquid ejecting head 26 is improved. Further, the inertance between the first coupling portion 324 and the pressure chamber 364 is smaller than the inertance between the second coupling portion 344 and the branching point 369 with the nozzle 362. Accordingly, propagation of the residual vibration from the second common liquid chamber 34 to the nozzle 362 is reduced. Therefore, since the residual vibration propagated from the second common liquid chamber 34 to the nozzle 362 is quickly attenuated, in the liquid ejecting head 26, the occurrence of crosstalk can be reduced even when an ejection frequency of the liquid ejecting head 26 is reduced.

Further, the flow channel resistance between the first coupling portion 324 and the pressure chamber 364 is smaller than the flow channel resistance between the second coupling portion 344 and the branching point 369 with the nozzle 362. Accordingly, the flow channel resistance of the first coupling flow channel 366 can be made smaller than the flow channel resistance of the second coupling flow channel 368 without increasing the flow channel resistance between the pressure chamber 364 and the nozzle 362. Accordingly, the liquid can smoothly move from the pressure chamber 364 to the nozzle 362, so that the liquid ejection efficiency of the liquid ejecting head 26 is improved.

According to the liquid ejecting head 26 of the first embodiment as described above, the compliance of the first common liquid chamber 32 is larger than the compliance of the second common liquid chamber 34, and the flow channel resistance between the first coupling portion 324 and the pressure chamber 364 is smaller than the flow channel resistance between the second coupling portion 344 and the pressure chamber 364. Therefore, in the liquid ejecting head 26, when the pressure of the liquid in the pressure chamber 364 changes, vibration by a pressure wave from the pressure chamber 364 toward the first common liquid chamber 32 can be absorbed by the compliance of the first common liquid chamber 32. Therefore, in the liquid ejecting head 26, the occurrence of crosstalk caused as the residual vibration remaining after being propagated to the first common liquid chamber 32 side moves toward the individual flow channel 36 can be reduced. Further, the flow channel resistance of the second coupling flow channel 368 coupled to the second common liquid chamber 34 having a relatively small compliance is relatively large, so that a possibility of inflow of the amount of the liquid exceeding the compliance can be reduced. Accordingly, the occurrence of crosstalk caused as the residual vibration remaining after being propagated to the second common liquid chamber 34 side moves toward the individual flow channel 36 is reduced without increasing the compliance of the second common liquid chamber 34, so that an increase in the size of the second common liquid chamber 34 required when the compliance of the second common liquid chamber 34 increases can be suppressed. Therefore, the liquid ejecting head 26 can be easily downsized.

Further, according to the above-described first embodiment, since the inertance between the first coupling portion 324 and the pressure chamber 364 is smaller than the inertance between the second coupling portion 344 and the pressure chamber 364, the liquid in the individual flow channel 36 flows more easily in the first common liquid chamber 32 than in the second common liquid chamber 34. Therefore, the liquid ejecting head 26 can be more easily downsized.

B. Second Embodiment

Figure 5:
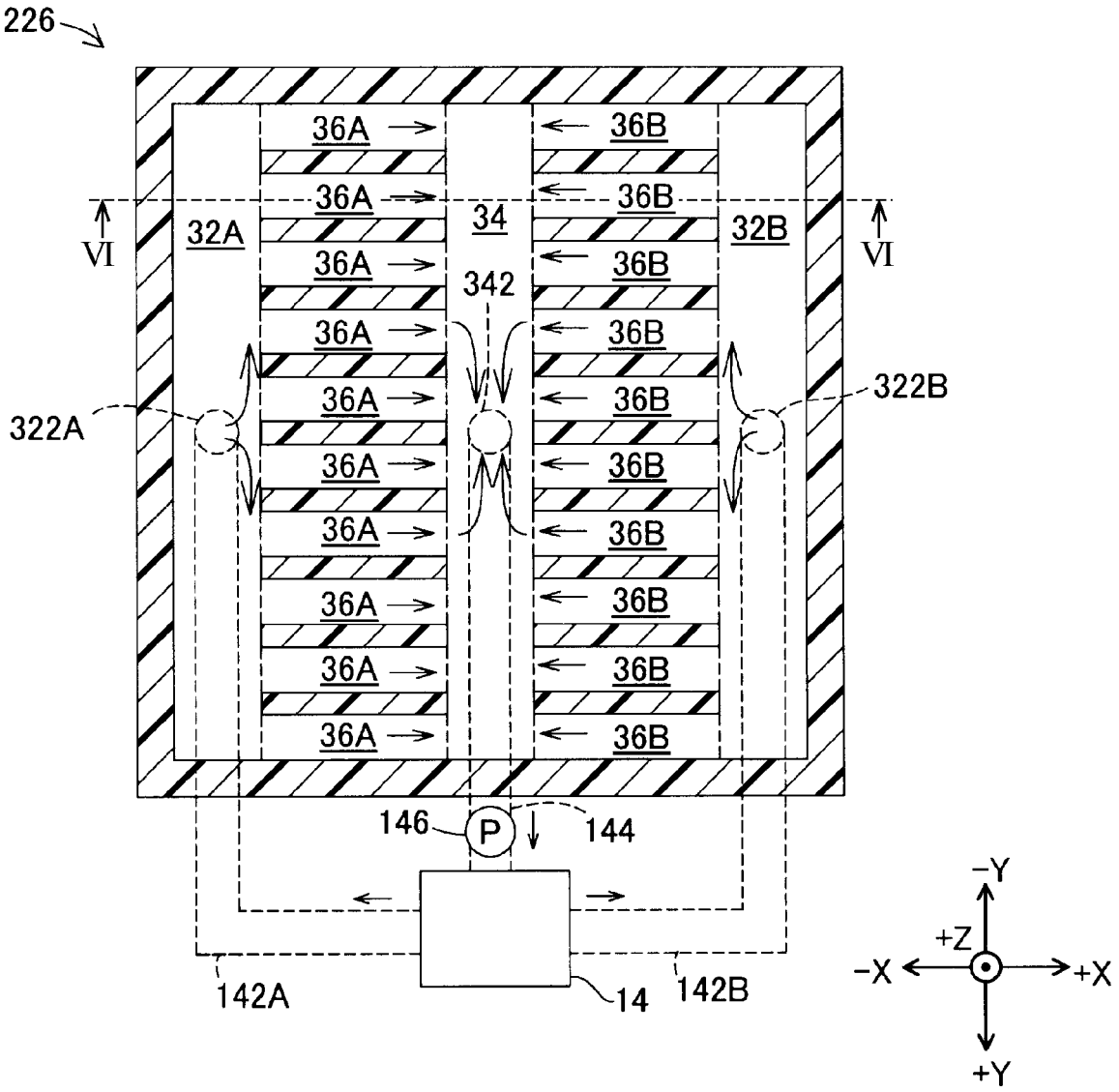
FIG. 5 is a schematic sectional view of the liquid ejecting head in the XY plane.

FIG. 5 is a schematic sectional view of the liquid ejecting head 26 in the XY plane. The liquid ejecting head 226 is different from that according to the first embodiment in that the liquid ejecting head 226 includes two first common liquid chambers 32A and 32B and one second common liquid chamber 34. The two first common liquid chambers 32A and 32B are coupled to the second common liquid chamber 34 through different individual flow channels 36A and 36B, respectively. Therefore, the liquid ejecting head 226 has, in the X direction that is a main scanning direction, two nozzle rows having the plurality of nozzles 362 arranged in the Y direction that is a sub scanning direction. Hereinafter, the same components as those according to the first embodiment are designated by the same reference numerals as those according to the first embodiment, and detailed description thereof will be omitted.

The liquid in the liquid ejecting head 226 circulates through the following path. The liquid supplied from the liquid storage container 14 flows into the one first common liquid chamber 32A via one supply flow channel 142A among two supply flow channels 142A and 142B and flows into the other first common liquid chamber 32B via the other supply flow channel 142B among the two supply flow channels 142A and 142B. The liquid that has flowed into the first common liquid chambers 32A and 32B flows into each of the plurality of different individual flow channels 36 coupled to the two first common liquid chambers 32A and 32B. The liquid that has flowed into the plurality of individual flow channels 36 flows into the second common liquid chamber 34 that is commonly coupled to the entire individual flow channels 36. The liquid in the second common liquid chamber 34 is recovered into the liquid storage container 14 via the recovery flow channel 144. The liquid recovered in the liquid storage container 14 is supplied to the liquid ejecting head 226 via the two supply flow channels 142A and 142B again.

Figure 6:
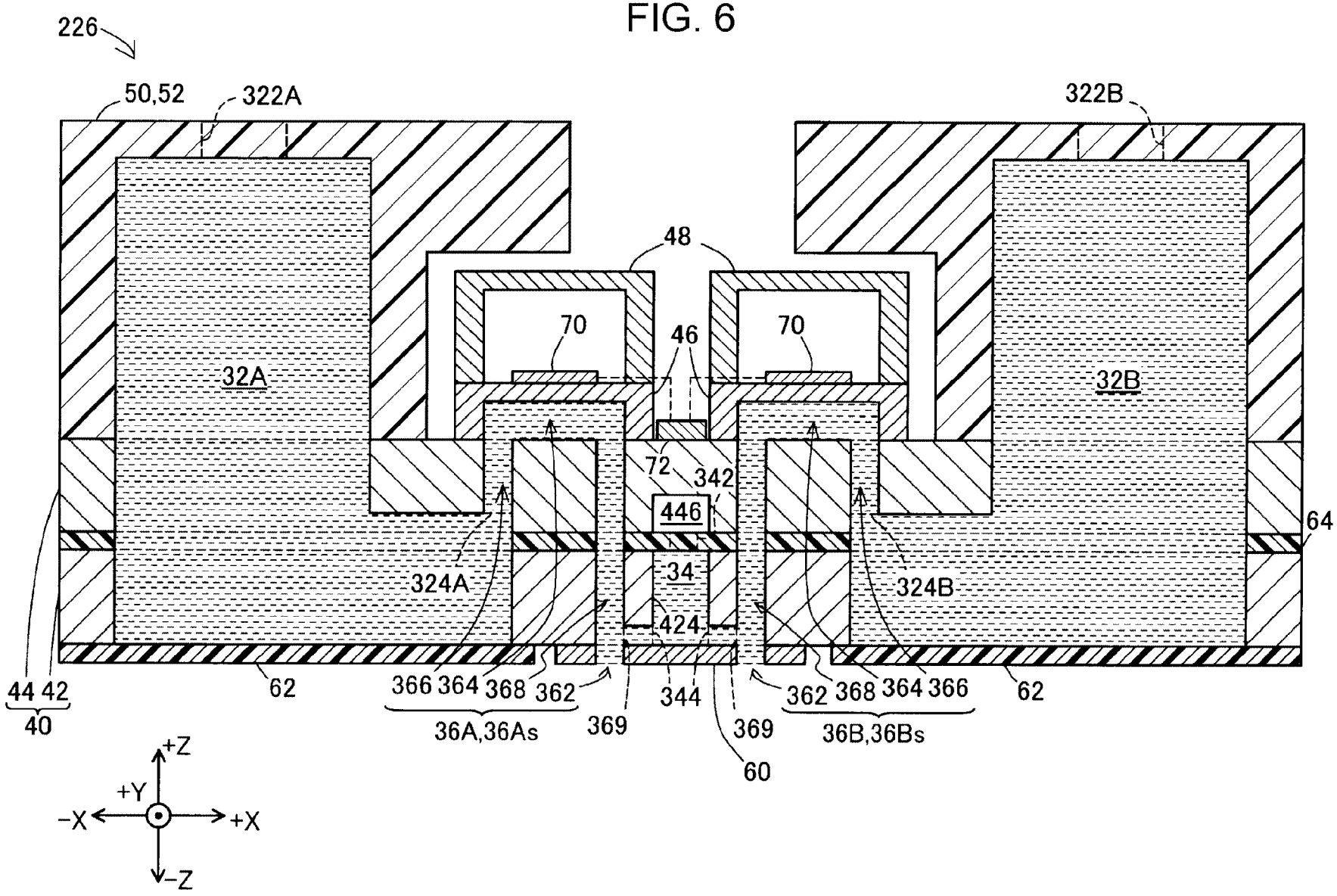
FIG. 6 is a schematic sectional view of the liquid ejecting head, which is taken along line VI-VI of FIG. 5.

FIG. 6 is a schematic sectional view of the liquid ejecting head 226, which is taken along line VI-VI of FIG. 5. Even in the present embodiment, the electrode 72 electrically coupled to the pressure generating element 70 is disposed at a position overlapping the second common liquid chamber 34 in the Z direction. Hereinafter, the plurality of individual flow channels 36A coupling the one first common liquid chamber 32A and the second common liquid chamber 34 are referred to as an individual flow channel group 36As, and the plurality of individual flow channels 36B coupling the one first common liquid chamber 32B and the second common liquid chamber 34 are referred to as an individual flow channel group 36Bs. In the present embodiment, the numbers of the individual flow channels 36A and 36B respectively included in the one individual flow channel group 36As and the other individual flow channel group 36Bs are the same. However, the numbers of the individual flow channels 36A and 36B may be different from each other.

When the pressure of the liquid simultaneously changes in the pressure chamber 364 of each of the individual flow channel groups 36As and 36Bs, the vibration is propagated to the first common liquid chambers 32A and 32B from the individual flow channel groups 36As and 36Bs coupled to the first common liquid chambers 32A and 32B, respectively. On the other hand, the vibration is propagated from the coupled individual flow channel groups 36As and 36Bs to the second common liquid chamber 34. Therefore, the number of the pressure chambers 364 that are generation sources of the vibration propagated to the second common liquid chamber 34 is twice the number of the pressure chambers 364 that are generation sources of the vibration propagated to the first common liquid chambers 32A and 32B. Therefore, in the liquid ejecting head 226, it is necessary to set the compliance in consideration of a ratio of the number of the individual flow channels 36 coupled to each of the first common liquid chamber 32A and 32B to the number of the individual flow channels 36 coupled to the second common liquid chamber 34.

The compliance of each of the first common liquid chambers 32A and 32B is larger than a half of the compliance of the second common liquid chamber 34. In this case, it is preferable that the compliance of the first common liquid chamber 32 is larger than 1.5 times a half of the compliance of the second common liquid chamber 34, and it is more preferable that the compliance of the first common liquid chamber 32 is larger than 2 times a half of the compliance of the second common liquid chamber 34. Therefore, even when a larger amount of the liquid flows in the first common liquid chamber 32 than in the second common liquid chamber 34, the occurrence of crosstalk can be reduced. Therefore, even when the sum of the amounts of the liquids flowing into the two first common liquid chambers 32A and 32B is larger than the amount of the liquid flowing into the second common liquid chamber 34, the occurrence of crosstalk can be reduced.

In the individual flow channel group 36As, the flow channel resistance of the first coupling flow channel 366 between the first coupling portion 324A in the first common liquid chamber 32A and the pressure chamber 364 is smaller than the flow channel resistance of the second coupling flow channel 368 between the second coupling portion 344 and the pressure chamber 364. Similarly, in the individual flow channel group 36Bs, the flow channel resistance of the first coupling flow channel 366 between the first coupling portion 324B in the first common liquid chamber 32B and the pressure chamber 364 is smaller than the flow channel resistance of the second coupling flow channel 368 between the second coupling portion 344 and the pressure chamber 364. Further, the inertance of the first coupling flow channel 366 in the individual flow channel group 36As is smaller than the inertance of the second coupling flow channel 368, and the inertance of the first coupling flow channel 366 in the individual flow channel group 36Bs is smaller than the inertance of the second coupling flow channel 368. Further, in the individual flow channel group 36As, the inertance between the first coupling portion 324A and the pressure chamber 364 is smaller than the inertance between the second coupling portion 344 and the branching point 369 with the nozzle 362. In the individual flow channel group 36Bs, the inertance between the first coupling portion 324B and the pressure chamber 364 is smaller than the inertance between the second coupling portion 344 and the branching point 369 with the nozzle 362. Accordingly, the flow channel resistance of the first coupling flow channel 366 can be made larger than the flow channel resistance of the second coupling flow channel 368 without increasing the inertance between the pressure chamber 364 and the nozzle 362. Accordingly, the liquid can smoothly move from the pressure chamber 364 to the nozzle 362, so that liquid ejection efficiency in the liquid ejecting head 226 is improved.

The liquid ejecting head 226 of the second embodiment described above has the same configuration as that of the first embodiment, so that the same effect is achieved. Further, according to the liquid ejecting head 226 of the second embodiment, the compliance of each of the first common liquid chambers 32A and 32B is larger than a half of the compliance of the second common liquid chamber 34. Further, in the individual flow channel groups 36As and 36Bs between the first common liquid chambers 32A and 32B and the second common liquid chamber 34, the flow channel resistance between the first coupling portions 324A and 324B and the pressure chamber 364 is smaller than the flow channel resistance between the second coupling portion 344 and the pressure chamber 364. Therefore, in the liquid ejecting head 226, when the pressure of the liquid in the pressure chamber 364 changes, vibration by a pressure wave from the pressure chamber 364 toward the first common liquid chambers 32A and 32B can be absorbed by the compliance of the first common liquid chambers 32A and 32B. Therefore, in the liquid ejecting head 226, the occurrence of crosstalk caused as the residual vibration remaining after being propagated to the first common liquid chambers 32A and 32B side moves toward the individual flow channel 36 can be reduced. Further, the flow channel resistance of the second coupling flow channel 368 coupled to the second common liquid chamber 34 having a relatively small compliance is relatively large, so that a possibility of inflow of the amount of the liquid exceeding the compliance can be reduced. Accordingly, the occurrence of crosstalk caused as the residual vibration remaining after being propagated to the second common liquid chamber 34 side moves toward the individual flow channel 36 is reduced without increasing the compliance of the second common liquid chamber 34, so that an increase in the size of the second common liquid chamber 34 required when the compliance of the second common liquid chamber 34 increases can be suppressed. Therefore, the liquid ejecting head 26 can be easily downsized.

Further, according to the above-described second embodiment, the electrode 72 electrically coupled to the pressure generating element 70 is disposed at a position overlapping the second common liquid chamber 34 in the Z direction. Here, the second common liquid chamber 34 has a relatively small compliance, and has the second dimension L2 that is smaller than the first dimension L1. Therefore, as compared to a case where the electrode 72 is disposed at a position overlapping the first common liquid chamber 32 in the Z direction, the dimension of the entire liquid ejecting head 226 in the Z direction is easily downsized. Further, in the liquid ejecting head 226 having a plurality of rows of the nozzles 362 in the X direction, as compared to a case where the electrode 72 is disposed at a position not overlapping the first common liquid chamber 32 and the second common liquid chamber 34 in the Z direction, the dimension of the liquid ejecting head 226 in the XY direction is easily downsized.

C. Third Embodiment

Figure 7:
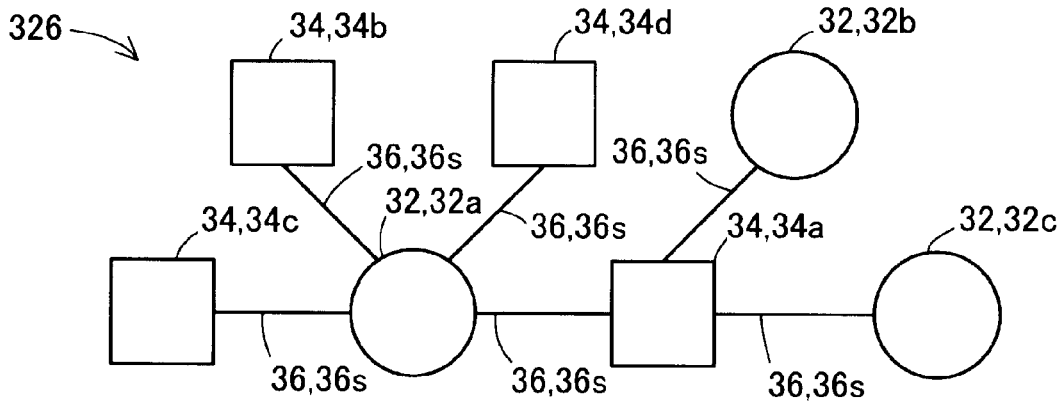
FIG. 7 is an example illustrating a configuration of a liquid ejecting head according to a third embodiment.

FIG. 7 is an example illustrating a configuration of a liquid ejecting head 326 according to a third embodiment. In the third embodiment, the liquid ejecting head 326 is different from that of the second embodiment in that the liquid ejecting head 326 has M (M is an integer of 1 or more) first common liquid chambers 32 and N (N is an integer of 1 or more) second common liquid chambers 34. At least one of the plurality of individual flow channels 36 constituting the individual flow channel group 36*s* couples one of the M first common liquid chambers 32 and one of the N second common liquid chambers 34. Hereinafter, the same configurations as those according to the first embodiment are designated by the same reference numerals, and detailed description thereof will be omitted. In the present embodiment, although the numbers of the individual flow channels 36 included in the plurality of individual flow channel groups 36*s* are the same, the numbers of the individual flow channels 36A and 36B may be different from each other.

When one of the M first common liquid chambers 32 is set as a representative first common liquid chamber 32, the representative first common liquid chamber 32 is coupled to each of the n (n is an integer of 1 or more and N or less) second common liquid chambers 34 via different individual flow channels constituting the individual flow channel group 36*s*. Further, when one of the n second common liquid chambers 34 coupled to the representative first common liquid chamber 32 is set as a representative second common liquid chamber 34, the representative second common liquid chamber 34 is coupled to each of the m (m is an integer of 1 or more and M or less) first common liquid chambers 32 including the representative first common liquid chamber 32 via different individual flow channels constituting the individual flow channel group 36*s*.

When the pressure of the liquid simultaneously changes in the pressure chamber 364 of each of the individual flow channels constituting the individual flow channel group 36*s*, the vibration is propagated to each of the first common liquid chambers 32 from the individual flow channel constituting the individual flow channel group 36*s* and coupled to the first common liquid chambers 32. On the other hand, the vibration is propagated to each of the second common liquid chambers 34 from the individual flow channel constituting the individual flow channel group 36*s* and coupled to the second common liquid chambers 34. Therefore, the number of the pressure chambers 364 serving as generation sources of the vibration propagated to the representative second common liquid chamber 34 is m/n times the number of the pressure chambers 364 serving as generation sources of the vibration propagated to the representative first common liquid chamber 32. Therefore, in the liquid ejecting head 226, it is necessary to set the compliance in consideration of a ratio of the number of the individual flow channels constituting the individual flow channel group 36*s* and respectively coupled to the first common liquid chambers 32 to the number of the individual flow channels constituting the individual flow channel group 36*s* and coupled to the second common liquid chamber 34.

The compliance of the representative first common liquid chamber 32 is larger than n/m times the compliance of the representative second common liquid chamber 34 that is one second common liquid chamber 34 coupled to the representative first common liquid chamber 32. In this case, it is preferable that the compliance of the first common liquid chamber 32 is larger than 1.5 times n/m times the compliance of the second common liquid chamber 34, and it is more preferable that the compliance of the first common liquid chamber 32 is larger than 2 times n/m times the compliance of the second common liquid chamber 34.

In this case, the flow channel resistance of the first coupling flow channel 366 in the representative first common liquid chamber 32 is smaller than the flow channel resistance of the second coupling flow channel 368 in the representative second common liquid chamber 34. Further, the inertance of the first coupling flow channel 366 in the representative first common liquid chamber 32 is smaller than the inertance of the second coupling flow channel 368 in the representative second common liquid chamber 34. Further, in the individual flow channel group 36*s* coupling the representative first common liquid chamber 32 and the representative second common liquid chamber 34, the inertance between the first coupling portion 324 and the pressure chamber 364 is smaller than the inertance between the second coupling portion 344 and the branching point 369 with the nozzle 362. Accordingly, the flow channel resistance of the first coupling flow channel 366 can be made larger than the flow channel resistance of the second coupling flow channel 368 without increasing the inertance between the pressure chamber 364 and the nozzle 362. Accordingly, the liquid can smoothly move from the pressure chamber 364 to the nozzle 362, so that liquid ejection efficiency of the liquid ejecting head 326 is improved.

Hereinafter, in a state in which specific numbers are applied to M, N, m, and n in the above description, the liquid ejecting head 326 will be described. The illustration in FIG. 7 is a schematic view of the liquid ejecting head 326 in the case of an example in which M=3 and N=4.

The liquid ejecting head 326 illustrated in FIG. 7 has three first common liquid chambers 32*a* to 32*c* and four second common liquid chambers 34*a* to 34*d*. For example, when the first common liquid chamber 32*a* is set as the representative first common liquid chamber, the four second common liquid chambers 34*a* to 34*d* are coupled to the representative first common liquid chamber 32*a*. In this case, when the second common liquid chamber 34*a* that is one of the four second common liquid chambers 34*a* to 34*d* coupled to the representative first common liquid chamber 32*a* is set as the representative second common liquid chamber, the representative second common liquid chamber 34*a* is coupled to the three first common liquid chambers 32*a* to 32*c* including the representative first common liquid chamber 32*a*.

The compliance of the representative first common liquid chamber 32*a* is larger than ¾ times the compliance of the representative second common liquid chamber 34*a*. Further, the flow channel resistance between the first coupling portion 324 and the pressure chamber 364 in the representative first common liquid chamber 32*a* is smaller than the flow channel resistance between the second coupling portion 344 and the pressure chamber 364. In the individual flow channel group 36*s*, the inertance between the first coupling portion 324 and the pressure chamber 364 in the representative first common liquid chamber 32 is smaller than the inertance between the second coupling portion 344 and the pressure chamber 364 in the representative second common liquid chamber 34*a*. Further, in the individual flow channel group 36*s*, the inertance between the first coupling portion 324 and the pressure chamber 364 in the representative first common liquid chamber 32 is smaller than the inertance between the second coupling portion 344 and the branching point 369 with the nozzle 362.

Further, for example, when the first common liquid chamber 32*b* is set as the representative first common liquid chamber, the one second common liquid chamber 34*a* is coupled to the representative first common liquid chamber 32*b*. In this case, the only one second common liquid chamber 34*b* coupled to the representative first common liquid chamber 32*b* is the representative second common liquid chamber 34*a*. The representative second common liquid chamber 34*a* is coupled to the three first common liquid chambers 32*a* to 32*c* including the representative first common liquid chamber 32*b*.

The compliance of the representative first common liquid chamber 32*b* is larger than 3 times the compliance of the representative second common liquid chamber 34*a*. Further, the flow channel resistance between the first coupling portion 324 and the pressure chamber 364 in the representative first common liquid chamber 32*b* is smaller than the flow channel resistance between the second coupling portion 344 and the pressure chamber 364. In the individual flow channel group 36*s*, the inertance between the first coupling portion 324 and the pressure chamber 364 in the representative first common liquid chamber 32*b* is smaller than the inertance between the second coupling portion 344 and the pressure chamber 364 in the representative second common liquid chamber 34*b*. Further, in the individual flow channel group 36*s*, the inertance between the first coupling portion 324 and the pressure chamber 364 in the representative first common liquid chamber 32*b* is smaller than the inertance between the second coupling portion 344 and the branching point 369 with the nozzle 362. Accordingly, propagation of the residual vibration from the representative second common liquid chamber 34*a* to the nozzle 362 is reduced.

The above-described third embodiment has the same configuration as those of the first embodiment and the second embodiment, so that the same effect is achieved. Further, according to the third embodiment, a relationship between the compliance capabilities of the first common liquid chamber 32 and the second common liquid chamber 34 illustrated in the first embodiment and the second embodiment can be generalized. Accordingly, even when the numbers of the first common liquid chambers 32 and the second common liquid chambers 34 are respectively changed to predetermined numbers, both a reduction in the occurrence of crosstalk and a reduction in the size can be achieved. When M=1 and N=1, the configuration is the same as that of the first embodiment. Further, when M=2 and N=1, the configuration is the same as that of the second embodiment.

D. Other Embodiment

D1. First Other Embodiment

In the above embodiment, the shape and the structure of the first common liquid chamber 32 and the second common liquid chamber 34 can be changed appropriately. For example, although the top surface of the first common liquid chamber 32 extends along the XY plane, the shape of the top surface in the first common liquid chamber 32 is not limited thereto. For example, the shape of the top surface in the first common liquid chamber 32 may have a tapered shape extending in a direction intersecting the XY plane. In this case, the first dimension L1 that is a dimension of the first common liquid chamber 32 in the Z direction is the maximum distance between the top surface and the bottom surface facing the top surface in the Z direction. Further, in the above embodiment, the supply port 322 is provided on the top surface of the first common liquid chamber 32. However, the present disclosure is not limited thereto. For example, the supply port 322 may be provided on the side surface of the first common liquid chamber 32. Further, in the above embodiment, the discharge port 342 is provided on the top surface of the second common liquid chamber 34. However, the present disclosure is not limited thereto. For example, the first coupling portion 324 may be provided on the side surface of the second common liquid chamber 34.

Further, for example, although the compliance of the first common liquid chamber 32 is secured by the first film 62 that defines the bottom surface, the present disclosure is not limited thereto. Further, for example, although the compliance of the second common liquid chamber 34 is secured by the second film 64 that defines the top surface, the present disclosure is not limited thereto. For example, the first film 62 may be provided on the top surface or the side surface of the first common liquid chamber 32, and the second film 64 may be provided on the bottom surface or the side surface of the second common liquid chamber 34. Further, the compliance capabilities of the first common liquid chamber 32 and the second common liquid chamber 34 may be secured using a member other than the first film 62 and the second film 64.

Figure 8:
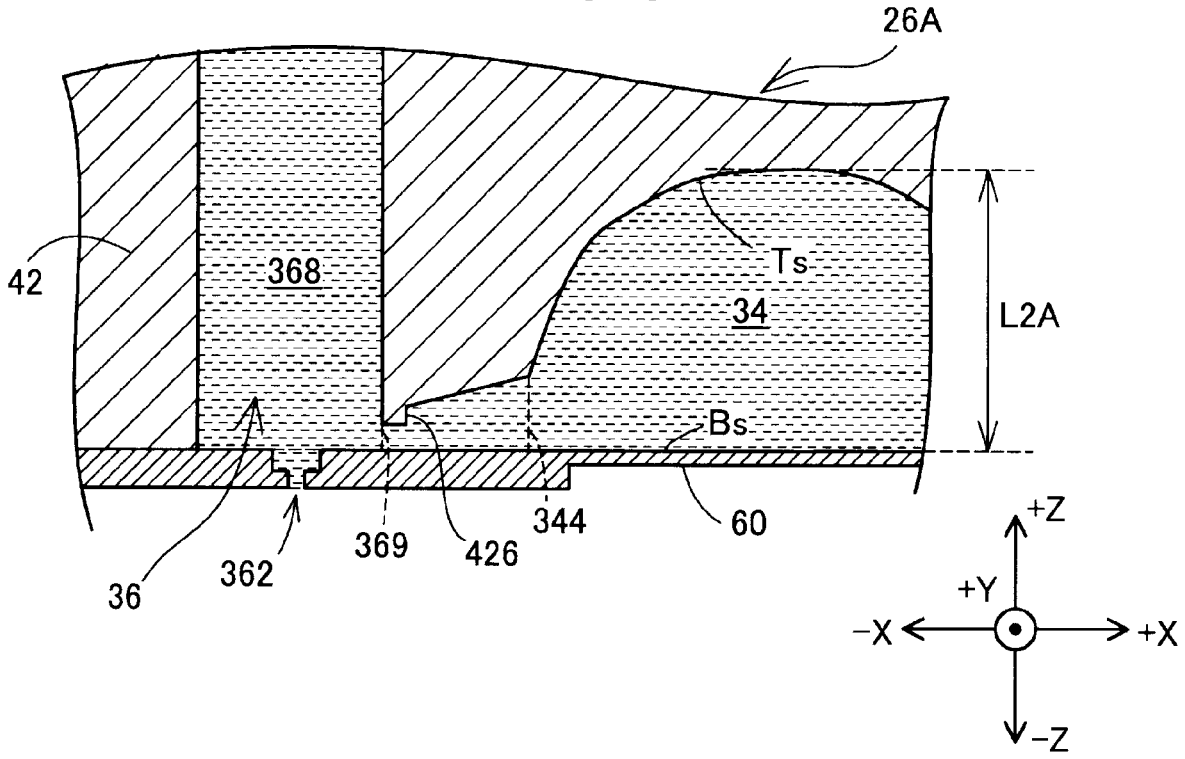
FIG. 8 is a diagram illustrating an example of a structure of a liquid ejecting head according to a first other embodiment.

FIG. 8 is a diagram illustrating an example of a structure of a liquid ejecting head 26A according to a first other embodiment. As the second common liquid chamber 34 is easily downsized, the shape of the second common liquid chamber 34 is easily changed. Therefore, for example, as illustrated in FIG. 7, the shape of the second common liquid chamber 34, specifically, the shape of a top surface Ts of the second common liquid chamber 34 may be an arch shape partially having a tapered shape. In this case, the wall surface defining the second common liquid chamber 34 can be thickened, so that the rigidity of the liquid ejecting head 26A can be improved. Further, in the liquid ejecting head 26A, a dimension L2A of the second common liquid chamber 34 in the Z direction is the maximum distance between the top surface Ts and a bottom surface Bs facing the top surface Ts in the Z direction. Further, as illustrated in FIG. 8, the compliance of the second common liquid chamber 34 may be secured by using the nozzle plate 60. That is, as the thickness of a portion of the nozzle plate 60, which covers an opening portion forming the second common liquid chamber 34, in the Z direction is made thinner than the thickness of the other portion of the nozzle plate 60, the residual vibration of the second common liquid chamber 34 may be absorbed.

D2. Second Other Embodiment

In the above embodiment, one first common liquid chamber 32 and one second common liquid chamber 34 are coupled to each other by one individual flow channel 36. However, the numbers of the first common liquid chamber 32 and the second common liquid chamber 34 coupled to each other by the one individual flow channel 36 are not limited thereto. For example, the number of at least one of the first common liquid chamber 32 and the second common liquid chamber 34 coupled to each other by the one individual flow channel 36 may be two or more.

Figure 9:
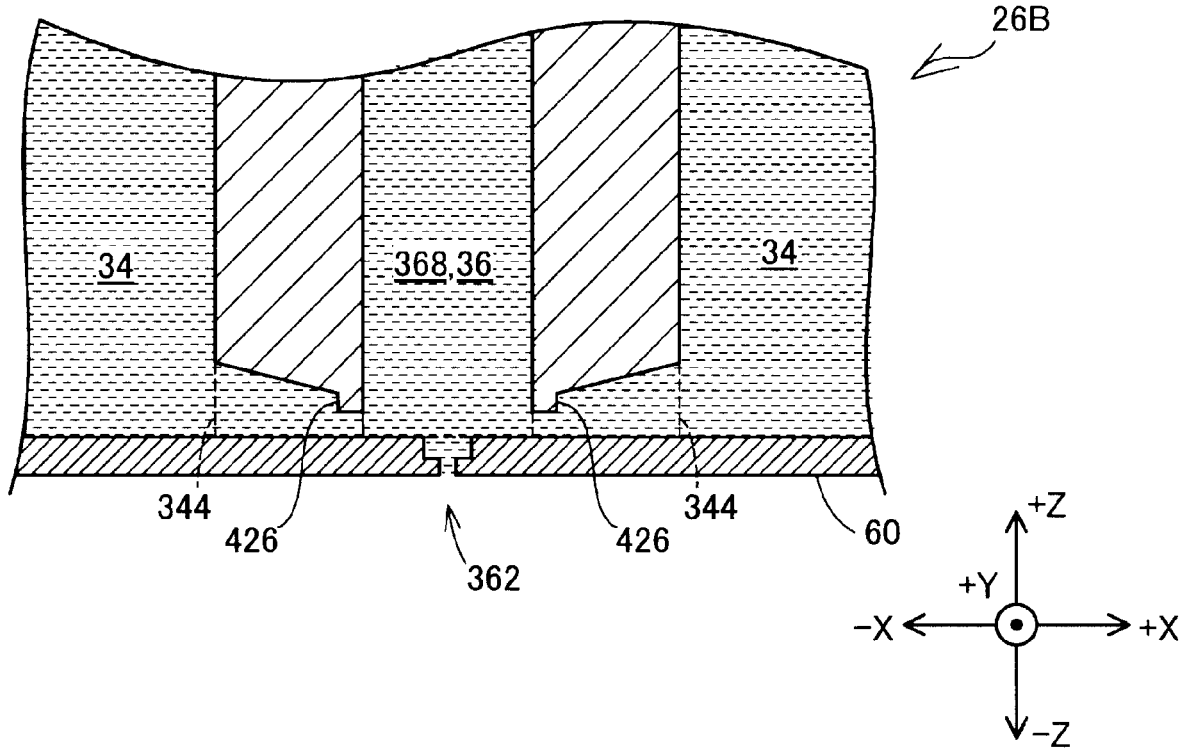
FIG. 9 is a schematic diagram illustrating an example of a liquid ejecting head according to a second other embodiment.

FIG. 9 is a schematic view illustrating an example of a liquid ejecting head 26B according to a second other embodiment. In the example illustrated in FIG. 9, a state in which two second common liquid chambers 34 are coupled to the one individual flow channel 36 is illustrated. In this case, when the number of the first common liquid chamber 32 coupled to the one individual flow channel 36 is one, it is preferable that the compliance of the first common liquid chamber 32 is larger than two times the compliance of the two second common liquid chambers 34 coupled to the first common liquid chamber 32. In this case, it is preferable that the compliance of the first common liquid chamber 32 is larger than 1.5 times 2 times the compliance of the second common liquid chamber 34, and it is more preferable that the compliance of the first common liquid chamber 32 is larger than 2 times 2 times the compliance of the second common liquid chamber 34.

In the example of FIG. 9, an area of the nozzle plate 60, which defines the bottom surface Bs of the second common liquid chamber 34, is thinned, so that the compliance of the second common liquid chamber 34 is improved. Further, in this case, the liquid ejecting head 26B may not be provided with the second film 64. Further, in this case, the first flow channel substrate 40 may include only the first communication plate 42.

D3. Third Other Embodiment

The method of improving the compliance capabilities of the first common liquid chamber 32 and the second common liquid chamber 34 is not limited to the above embodiment. For example, the sizes of the openings, for example, the supply port 322 and the discharge port 342, formed in the first common liquid chamber 32 and the second common liquid chamber 34 increases, so that the compliance capabilities of the first common liquid chamber 32 and the second common liquid chamber 34 may be improved. For example, the flexibility of the nozzle plate 60 is improved by thinning the area of the nozzle plate 60, which defines the bottom surface of the second common liquid chamber 34. Accordingly, the compliance of the second common liquid chamber 34 may be improved. Further, for example, a configuration in which the area of the nozzle plate 60, which defines the bottom surface of the second common liquid chamber 34, is cut out, and the cutout area is blocked with a film member is changed, so that the compliance of the second common liquid chamber 34 may be improved.

D4. Fourth Other Embodiment

A relationship between the first dimension L1 of the first common liquid chamber 32 and the second dimension L2 of the second common liquid chamber 34 is not limited to the above embodiment, and can be changed as long as the relationship between the compliance capabilities of the first common liquid chamber 32 and the second common liquid chamber 34 is secured. For example, the first dimension L1 may be less than 3 times the second dimension L2. Further, both the first common liquid chamber 32 and the second common liquid chamber 34 may have internal spaces extending both on the nozzle plate 60 from the pressure generating element 70 and on an opposite side to the nozzle plate 60 from the pressure generating element 70. Further, both the first common liquid chamber 32 and the second common liquid chamber 34 may have only an internal space extending from the pressure generating element 70 to the nozzle plate 60. Further, the first dimension L1 may be equal to or smaller than the second dimension. The second dimension L2 may be equal to or larger than 1 mm.

Further, a relationship between the volume of the first common liquid chamber 32 and the volume of the second common liquid chamber 34 is not limited to the above embodiment, and can be changed while the relationship between the compliance capabilities of the first common liquid chamber 32 and the second common liquid chamber 34 is secured. For example, in the first embodiment, when the compliance of the first common liquid chamber 32 is designed to be larger than the compliance of the second common liquid chamber 34 due to a factor other than the volume, the volume of the first common liquid chamber 32 may be equal to or less than the volume of the second common liquid chamber 34.

D5. Fifth Other Embodiment

In the above embodiment, the first flow channel substrate 40 and the case 52 that is the second flow channel substrate 50 are made of different materials. However, the first flow channel substrate 40 and the case 52 that is the second flow channel substrate 50 may be made of the same material. In detail, for example, both the first flow channel substrate 40 and the second flow channel substrate 50 may be formed of plastic. Further, for example, both the first flow channel substrate 40 and the second flow channel substrate 50 may be formed of a silicon single crystal plate.

D6. Sixth Other Embodiment

In the above embodiment, the first common liquid chamber 32 is located upstream of the second common liquid chamber 34 in a liquid circulation path. However, the first common liquid chamber 32 may be located downstream of the second common liquid chamber 34. Further, the number of the individual flow channel 36 between the first common liquid chamber 32 and the second common liquid chamber 34 may be one.

D7. Seventh Other Embodiment

In the above embodiment, the inertance between the first coupling portion 324 and the pressure chamber 364 is smaller than the inertance between the second coupling portion 344 and the pressure chamber 364, and the flow channel resistance between the first coupling portion 324 and the pressure chamber 364 is smaller than the flow channel resistance between the second coupling portion 344 and the pressure chamber 364. However, the relationships of the inertance and the flow channel resistance can be changed as long as the occurrence of crosstalk can be reduced. For example, at least one of at least the inertance and the flow channel resistance may be smaller than between the first coupling portion 324 and the pressure chamber 364 than between the second coupling portion 344 and the pressure chamber 364.

In the above embodiment, the inertance between the first coupling portion 324 and the pressure chamber 364 is smaller than the inertance between the second coupling portion 344 and the branching point 369. However, the present disclosure is not limited thereto. For example, the inertance between the first coupling portion 324 and the pressure chamber 364 may be equal to or larger than the inertance between the second coupling portion 344 and the branching point 369. In this case, the nozzle 362 may not be provided between the second coupling portion 344 and the pressure chamber 364. In detail, for example, the nozzle 362 may be provided between the first coupling portion 324 and the pressure chamber 364.

D8. Eighth Other Embodiment

In the above embodiment, the partition wall 426 is provided in the second coupling flow channel 368. However, the present disclosure is not limited thereto. For example, the second coupling portion 344 may not include the partition wall 426. In this case, the second coupling portion 344 has a structure different from that of the partition wall 426, and thus, the inertance or the flow channel resistance may increase.

D9. Ninth Other Embodiment

In the above embodiment, the nozzle 362 is provided in the second coupling flow channel 368. However, the present disclosure is not limited thereto. For example, the nozzle 362 may be provided in the first coupling flow channel 366.

D10. Tenth Other Embodiment

In the above embodiment, the first communication plate 42, the second communication plate 44, the case 52, and the pressure chamber forming substrate 46 are provided as a flow channel forming substrate of a member that forms a flow channel structure. However, a combination of the flow channel forming substrate in which the first common liquid chamber 32, the second common liquid chamber 34, and the individual flow channel 36 are formed is not limited thereto. For example, the first common liquid chamber 32, the second common liquid chamber 34, and the individual flow channel 36 may be formed in one or more of the first communication plate 42, the second communication plate 44, the case 52, and the pressure chamber forming substrate 46. Further, the first communication plate 42, the second communication plate 44, the case 52, and the pressure chamber forming substrate 46 may be integrally formed by three-dimensional modeling.

D11. Eleventh Other Embodiment

In the second and third embodiments, each of the individual flow channel groups **36*s* includes the same number of the individual flow channels 36. However, the present disclosure is not limited thereto. For example, the plurality of individual flow channel groups 36*s* may include different numbers of the individual flow channels 36**.

The first to eleventh other embodiments have the same configuration as the above embodiment, so that the same effect is achieved.

D12. Twelfth Other Embodiment

The present disclosure is not limited to an ink jet printer and an ink tank for supplying an ink to the ink jet printer, and can be applied to a predetermined liquid ejecting apparatus that ejects various liquids including the ink and a liquid tank that stores the liquids. For example, the present disclosure can be applied to the following various liquid ejecting apparatuses and the following liquid storage containers thereof.

(1) An image recording apparatus such as a facsimile machine, (2) A color material ejecting apparatus used for manufacturing a color filter for an image display device such as a liquid crystal display, (3) An electrode material ejecting apparatus used for forming an electrode of an organic electro luminescence (EL) display, a surface light emission display (a field emission display, FED), and the like, (4) A liquid ejecting apparatus that ejects a liquid containing a bio-organic material used for manufacturing a biochip, (5) A sample ejecting apparatus as a precision pipette, (6) A lubricating oil ejecting apparatus, (7) A resin liquid ejecting apparatus, (8) A liquid ejecting apparatus that ejects a lubricating oil to a precision machine such as a timepiece and a camera using a pinpoint, (9) A liquid ejecting apparatus that ejects a transparent resin liquid such as an ultraviolet curable resin liquid onto a substrate in order to form a micro hemispherical lens (optical lens) used for an optical communication element or the like,

(10) A liquid ejecting apparatus that ejects an acidic or alkaline etching solution for etching a substrate or the like, and

(11) A liquid ejecting apparatus including a liquid ejecting head that ejects the small amount of other predetermined liquid droplets.

The "liquid droplets" refer to a state of the liquid ejected from the liquid ejecting apparatus, which includes a particle shape, a tear shape, and a shape obtained by pulling a tail in a thread shape. Further, the "liquid" herein may be any material that can be ejected by the liquid ejecting apparatus. For example, the "liquid" may be a material in a state in which a substance is in a liquid phase, and also includes a liquid material such as a material in a liquid state having high or low viscosity, sol, gel water, other inorganic solvents, organic solvents, solutions, liquid resins, and liquid metals (metallic melts). Further, the "liquid" includes not only a liquid as one state of a substance but also a liquid in which particles of a functional material made of a solid such as a pigment or metal particles are dissolved, dispersed, or mixed in a solvent. Further, representative examples of the liquid include the ink, the liquid crystal, and the like as described in the above embodiment. Here, the ink includes various liquid compositions such as general water-based ink, oil-based ink, and gel ink.

The present disclosure is not limited to the above-described embodiment, and can be realized with various configurations without departing from the spirit of the present disclosure. For example, the technical features of the embodiments corresponding to the technical features in each aspect described in the summary of the present disclosure can be appropriately replaced or combined in order to solve some or the entirety of the above-described problems or achieve some or the entirety of the above-described effects. Further, when the technical features are not described as essential in the present specification, the technical features can be deleted as appropriate.

(1) According to an aspect of the present disclosure, a liquid ejecting head is provided. The liquid ejecting head includes: a flow channel forming substrate that forms an individual flow channel including a nozzle and a pressure chamber, a first common liquid chamber, and a second common liquid chamber; and a pressure generating element that causes a pressure change in a liquid in the pressure chamber, in which the first common liquid chamber is coupled to the second common liquid chamber via the individual flow channel, a compliance of the first common liquid chamber is larger than a compliance of the second common liquid chamber, and in the individual flow channel, a flow channel resistance between a first coupling portion with the first common liquid chamber and the pressure chamber is smaller than a flow channel resistance between a second coupling portion with the second common liquid chamber and the pressure chamber. According to the liquid ejecting head of the aspect, the compliance of the first common liquid chamber is larger than the compliance of the second common liquid chamber, and the flow channel resistance between the first coupling portion and the pressure chamber is smaller than the flow channel resistance between the second coupling portion and the pressure chamber. Therefore, in the liquid ejecting head, when the pressure of the liquid in the pressure chamber changes, vibration by a pressure wave from the pressure chamber toward the first common liquid chamber can be absorbed by the compliance of the first common liquid chamber. Therefore, in the liquid ejecting head, the occurrence of crosstalk caused as the residual vibration remaining after being propagated to the first common liquid chamber side moves toward the individual flow channel can be reduced. Further, as the flow channel resistance between the second coupling portion and the pressure chamber is large, inflow of the liquid into the second common liquid chamber can be reduced, so that the occurrence of crosstalk caused as the residual vibration remaining after being propagated to the second common liquid chamber side moves toward the individual flow channel is reduced. Therefore, the liquid ejecting head can be easily downsized.

(2) According to another aspect of the present disclosure, a liquid ejecting head is provided. The liquid ejecting head includes: a flow channel forming substrate that forms an individual flow channel including a nozzle and a pressure chamber, a first common liquid chamber, and a second common liquid chamber; and a pressure generating element that causes a pressure change in a liquid in the pressure chamber, in which the first common liquid chamber is coupled to the second common liquid chamber via the individual flow channel, a compliance of the first common liquid chamber is larger than a compliance of the second common liquid chamber, and in the individual flow channel, an inertance between a first coupling portion with the first common liquid chamber and the pressure chamber is smaller than an inertance between a second coupling portion with the second common liquid chamber and the pressure chamber. According to the liquid ejecting head of the aspect, the compliance of the first common liquid chamber is larger than the compliance of the second common liquid chamber, and the inertance between the first coupling portion and the pressure chamber is smaller than the inertance between the second coupling portion and the pressure chamber. Therefore, in the liquid ejecting head, when the pressure of the liquid in the pressure chamber changes, vibration by a pressure wave from the pressure chamber toward the first common liquid chamber can be absorbed by the compliance of the first common liquid chamber. Therefore, in the liquid ejecting head, the occurrence of crosstalk caused as the residual vibration remaining after being propagated to the first common liquid chamber side moves toward the individual flow channel can be reduced. Further, as the inertance between the second coupling portion and the pressure chamber is large, inflow of the liquid into the second common liquid chamber can be reduced, so that the occurrence of crosstalk caused as the residual vibration remaining after being propagated to the second common liquid chamber side moves toward the individual flow channel is reduced. Therefore, the liquid ejecting head can be easily downsized.

(3) In the liquid ejecting head of the aspect, in the individual flow channel, the inertance between the first coupling portion and the pressure chamber may be smaller than the inertance between the second coupling portion and the pressure chamber. According to the liquid ejecting head of the aspect, since the inertance between the first coupling portion and the pressure chamber is smaller than the inertance between the second coupling portion and the pressure chamber, the liquid in the individual flow channel is more likely to flow in the first common liquid chamber than in the second common liquid chamber. Therefore, the liquid ejecting head can be more easily downsized.

(4) In the liquid ejecting head of the aspect, the individual flow channel may branch off to the second coupling portion and the nozzle at a branching point between the pressure chamber and the second coupling portion, and an inertance between the first coupling portion and the pressure chamber may be smaller than an inertance between the second coupling portion and the branching point in the individual flow channel. According to the liquid ejecting head of the aspect, the inertance between the first coupling portion and the pressure chamber can smaller than the inertance between the second coupling portion and the pressure chamber without increasing an inertance between the pressure chamber and the nozzle. Accordingly, the liquid can smoothly move from the pressure chamber to the nozzle, so that liquid ejection efficiency of the liquid ejecting head is improved.

(5) According to yet another aspect of the present disclosure, a liquid ejecting head is provided. The liquid ejecting head includes: a flow channel forming substrate that forms a plurality of individual flow channels each including a nozzle and a pressure chamber, M (M is an integer of 1 or more) first common liquid chambers, and N (N is an integer of 1 or more) second common liquid chambers; and a pressure generating element that causes a pressure change in a liquid in the pressure chamber, in which at least one of the plurality of individual flow channels constitutes an individual flow channel group and couples corresponding one of the M first common liquid chambers and corresponding one of the N second common liquid chambers, a representative first common liquid chamber, which is one of the M first common liquid chambers, is coupled to each of n (n is an integer of 1 or more and N or less) second common liquid chambers among the N second common liquid chambers via corresponding one of the individual flow channels constituting the individual flow channel group, a representative second common liquid chamber, which is one of the n second common liquid chambers, is coupled to each of m (m is an integer of 1 or more and M or less) first common liquid chambers including the representative first common liquid chamber among the M first common liquid chambers via corresponding one of the individual flow channels constituting the individual flow channel group, a compliance of the representative first common liquid chamber is larger than n/m times a compliance of the representative second common liquid chamber, and in the individual flow channel constituting the individual flow channel group between the representative first common liquid chamber and the representative second common liquid chamber, a flow channel resistance between a first coupling portion with the representative first common liquid chamber and the pressure chamber is smaller than a flow channel resistance between a second coupling portion with the representative second common liquid chamber and the pressure chamber. According to the liquid ejecting head of the aspect, the compliance of the representative first common liquid chamber is larger than n/m times the compliance of the representative second common liquid chamber, and in the individual flow channel group between the representative first common liquid chamber and the representative second common liquid chamber, the flow channel resistance between the first coupling portion with the representative first common liquid chamber and the pressure chamber is smaller than the flow channel resistance between the second coupling portion with the representative second common liquid chamber and the pressure chamber. Therefore, in the liquid ejecting head, when the pressure of the liquid in the pressure chamber changes, vibration by a pressure wave from the pressure chamber toward the first common liquid chamber can be absorbed by the compliance of the first common liquid chamber. Therefore, in the liquid ejecting head, the occurrence of crosstalk caused as the residual vibration remaining after being propagated to the first common liquid chamber side moves toward the individual flow channel can be reduced. Further, as the flow channel resistance between the second coupling portion and the pressure chamber is large, inflow of the liquid into the second common liquid chamber can be reduced, so that the occurrence of crosstalk caused as the residual vibration remaining after being propagated to the second common liquid chamber side moves toward the individual flow channel is reduced. Therefore, the liquid ejecting head can be easily downsized.

(6) According to yet another aspect of the present disclosure, a liquid ejecting head is provided. The liquid ejecting head includes: a flow channel forming substrate that forms a plurality of individual flow channels each including a nozzle and a pressure chamber, M (M is an integer of 1 or more) first common liquid chambers, and N (N is an integer of 1 or more) second common liquid chambers; and a pressure generating element that causes a pressure change in a liquid in the pressure chamber, in which at least one of the plurality of individual flow channels constitutes an individual flow channel group, and couples at least corresponding one of the M first common liquid chambers and at least corresponding one of the N second common liquid chambers, a representative first common liquid chamber, which is one of the M first common liquid chambers, is coupled to each of n (n is an integer of 1 or more and N or less) second common liquid chambers among the N second common liquid chambers via corresponding one of the individual flow channels constituting the individual flow channel group, a representative second common liquid chamber, which is one of the n second common liquid chambers, is coupled to each of m (m is an integer of 1 or more and M or less) first common liquid chambers including the representative first common liquid chamber among the M first common liquid chambers via corresponding one of the individual flow channels constituting the individual flow channel group, a compliance of the representative first common liquid chamber is larger than n/m times a compliance of the representative second common liquid chamber, and in the individual flow channel constituting the individual flow channel group between the representative first common liquid chamber and the representative second common liquid chamber, an inertance between a first coupling portion with the representative first common liquid chamber and the pressure chamber is smaller than an inertance between a second coupling portion with the representative second common liquid chamber and the pressure chamber. Therefore, in the liquid ejecting head, when the pressure of the liquid in the pressure chamber changes, vibration by a pressure wave from the pressure chamber toward the first common liquid chamber can be absorbed by the compliance of the first common liquid chamber. Therefore, in the liquid ejecting head, the occurrence of crosstalk caused as the residual vibration remaining after being propagated to the first common liquid chamber side moves toward the individual flow channel can be reduced. Further, as the inertance between the second coupling portion and the pressure chamber is large, inflow of the liquid into the second common liquid chamber can be reduced, so that the occurrence of crosstalk caused as the residual vibration remaining after being propagated to the second common liquid chamber side moves toward the individual flow channel is reduced. Therefore, the liquid ejecting head can be easily downsized.

(7) According to the liquid ejecting head of the aspect, in the individual flow channel constituting the individual flow channel group between the representative first common liquid chamber and the representative second common liquid chamber, an inertance between the first coupling portion with the representative first common liquid chamber and the pressure chamber may be smaller than an inertance between the second coupling portion with the representative second common liquid chamber and the pressure chamber. According to the liquid ejecting head of the aspect, since the inertance between the first coupling portion and the pressure chamber is smaller than the inertance between the second coupling portion and the pressure chamber, the liquid in the individual flow channel is more likely to flow in the first common liquid chamber than in the second common liquid chamber. Therefore, the liquid ejecting head can be more easily downsized.

(8) In the liquid ejecting head of the aspect, the individual flow channel may branch off to the second coupling portion and the nozzle at a branching point between the pressure chamber and the second coupling portion, and in the individual flow channel constituting the individual flow channel group between the representative first common liquid chamber and the representative second common liquid chamber, an inertance between the first coupling portion and the pressure chamber may be smaller than an inertance between the second coupling portion and the branching point in the individual flow channel. According to the liquid ejecting head of the aspect, the inertance between the first coupling portion and the pressure chamber can smaller than the inertance between the second coupling portion and the pressure chamber without increasing an inertance between the pressure chamber and the nozzle. Accordingly, the liquid can smoothly move from the pressure chamber to the nozzle, so that liquid ejection efficiency of the liquid ejecting head is improved.

(9) In the liquid ejecting head of the aspect, M is 2, N is 1, m is 2, and n is 1, and an electrode electrically coupled to the pressure generating element may be disposed at a position overlapping the second common liquid chamber in a direction perpendicular to a nozzle surface at which the nozzle is formed. According to the liquid ejecting head of the aspect, it is easy to increase the dimension of the first common liquid chamber in a direction perpendicular to the nozzle surface. Accordingly, it is easy to increase the volume of the first common liquid chamber. However, it is easy to increase the compliance of the first common liquid chamber.

(10) In the liquid ejecting head of the aspect, a first dimension that is a dimension of the first common liquid chamber in a direction perpendicular to a nozzle surface at which the nozzle is formed may be larger than a second dimension that is a dimension of the second common liquid chamber in the direction. According to the liquid ejecting head of the aspect, it is easy to increase the volume of the first common liquid chamber. However, it is easy to increase the compliance of the first common liquid chamber.

(11) In the liquid ejecting head of the aspect, the first dimension may be equal to or larger than 3 times the second dimension. According to the liquid ejecting head of the aspect, it is easier to increase the volume of the first common liquid chamber. However, it is easy to increase the compliance of the first common liquid chamber.

(12) In the liquid ejecting head of the aspect, the second dimension may be 1 mm or less. According to the liquid ejecting head of the aspect, it is easy to reduce the size of the second common liquid chamber. Therefore, the liquid ejecting head can be more easily downsized.

(13) In the liquid ejecting head of the aspect, when, in a direction perpendicular to a nozzle surface at which the nozzle is formed, a direction from the pressure generating element to the nozzle surface may be one direction, a direction from the nozzle surface to the pressure generating element may be another direction, the first common liquid chamber may have an internal space extending both in the one direction from the pressure generating element and in the other direction from the pressure generating element, and the second common liquid chamber may have an internal space extending in the one direction from the pressure generating element. According to the liquid ejecting head of the aspect, it is easier to increase the volume of the first common liquid chamber. However, it is easy to increase the compliance of the first common liquid chamber.

(14) The liquid ejecting head of the aspect further includes: a first flow channel substrate in which the first common liquid chamber and the second common liquid chamber are formed; and a second flow channel substrate in which the first common liquid chamber is formed and the second common liquid chamber is not formed, in which the first flow channel substrate and the second flow channel substrate are stacked in a direction perpendicular to a nozzle surface at which the nozzle is formed. According to the liquid ejecting head of the aspect, it is easy to form the liquid ejecting head of the aspect.

(15) In the liquid ejecting head of the aspect, materials of the first flow channel substrate and the second flow channel substrate may be different from each other. According to the aspect, the liquid ejecting head can be provided in which the materials of the first flow channel substrate and the second flow channel substrate are different from each other. Therefore, the degree of freedom of design in the liquid ejecting head is improved.

The present disclosure can be realized in various forms other than the liquid ejecting head. For example, the present disclosure can be realized in the form of a liquid ejecting apparatus including the liquid ejecting head according to the above aspect and a method of manufacturing the liquid ejecting head and the liquid ejecting apparatus.

What is claimed is:

1. A liquid ejecting head comprising:

a flow channel forming substrate that forms an individual flow channel including a nozzle and a pressure chamber, a first common liquid chamber, and a second common liquid chamber; and a pressure generating element that causes a pressure change in a liquid in the pressure chamber, wherein the first common liquid chamber is coupled to the second common liquid chamber via the individual flow channel, a compliance of the first common liquid chamber is larger than a compliance of the second common liquid chamber, and in the individual flow channel, a flow channel resistance between a first coupling portion with the first common liquid chamber and the pressure chamber is smaller than a flow channel resistance between a second coupling portion with the second common liquid chamber and the pressure chamber.

2. The liquid ejecting head according to claim 1, wherein in the individual flow channel, an inertance between the first coupling portion and the pressure chamber is smaller than an inertance between the second coupling portion and the pressure chamber.

3. The liquid ejecting head according to claim 1, wherein the individual flow channel branches off to the second coupling portion and the nozzle at a branching point between the pressure chamber and the second coupling portion, and an inertance between the first coupling portion and the pressure chamber is smaller than an inertance between the second coupling portion and the branching point in the individual flow channel.

4. The liquid ejecting head according to claim 1, wherein a first dimension that is a dimension of the first common liquid chamber in a direction perpendicular to a nozzle surface at which the nozzle is formed is larger than a second dimension that is a dimension of the second common liquid chamber in the direction.

5. The liquid ejecting head according to claim 4, wherein the first dimension is equal to or larger than 3 times the second dimension.

6. The liquid ejecting head according to claim 4, wherein the second dimension is 1 mm or less.

7. The liquid ejecting head according to claim 1, wherein when, in a direction perpendicular to a nozzle surface at which the nozzle is formed, a direction from the pressure generating element to the nozzle surface is one direction, and a direction from the nozzle surface to the pressure generating element is another direction, the first common liquid chamber has an internal space extending both in the one direction from the pressure generating element and in the other direction from the pressure generating element, and the second common liquid chamber has an internal space extending in the one direction from the pressure generating element.

8. The liquid ejecting head according to claim 1, further comprising:

a first flow channel substrate in which the first common liquid chamber and the second common liquid chamber are formed; and a second flow channel substrate in which the first common liquid chamber is formed and the second common liquid chamber is not formed, wherein the first flow channel substrate and the second flow channel substrate are stacked in a direction perpendicular to a nozzle surface at which the nozzle is formed.

9. The liquid ejecting head according to claim 8, wherein materials of the first flow channel substrate and the second flow channel substrate are different from each other.

10. A liquid ejecting apparatus comprising:

the liquid ejecting head according to claim 1;

a liquid storage container that stores a liquid supplied to the liquid ejecting head; and a pump by which the liquid circulates between the liquid ejecting head and the liquid storage container.

11. A liquid ejecting head comprising:

a flow channel forming substrate that forms an individual flow channel including a nozzle and a pressure chamber, a first common liquid chamber, and a second common liquid chamber; and a pressure generating element that causes a pressure change in a liquid in the pressure chamber, wherein the first common liquid chamber is coupled to the second common liquid chamber via the individual flow channel, a compliance of the first common liquid chamber is larger than a compliance of the second common liquid chamber, and in the individual flow channel, an inertance between a first coupling portion with the first common liquid chamber and the pressure chamber is smaller than an inertance between a second coupling portion with the second common liquid chamber and the pressure chamber.

12. A liquid ejecting head comprising:

a flow channel forming substrate that forms a plurality of individual flow channels each including a nozzle and a pressure chamber, M (M is an integer of 1 or more) first common liquid chambers, and N (N is an integer of 1 or more) second common liquid chambers; and a pressure generating element that causes a pressure change in a liquid in the pressure chamber, wherein at least one of the plurality of individual flow channels constitutes an individual flow channel group, and couples corresponding one of the M first common liquid chambers and corresponding one of the N second common liquid chambers, a representative first common liquid chamber, which is one of the M first common liquid chambers, is coupled to each of n (n is an integer of 1 or more and N or less) second common liquid chambers among the N second common liquid chambers via corresponding one of the individual flow channels constituting the individual flow channel group, a representative second common liquid chamber, which is one of the n second common liquid chambers, is coupled to each of m (m is an integer of 1 or more and M or less) first common liquid chambers including the representative first common liquid chamber among the M first common liquid chambers via corresponding one of the individual flow channels constituting the individual flow channel group, a compliance of the representative first common liquid chamber is larger than n/m times a compliance of the representative second common liquid chamber, and in the individual flow channel constituting the individual flow channel group between the representative first common liquid chamber and the representative second common liquid chamber, a flow channel resistance between a first coupling portion with the representative first common liquid chamber and the pressure chamber is smaller than a flow channel resistance between a second coupling portion with the representative second common liquid chamber and the pressure chamber.

13. The liquid ejecting head according to claim 12, wherein in the individual flow channel constituting the individual flow channel group between the representative first common liquid chamber and the representative second common liquid chamber, an inertance between the first coupling portion with the representative first common liquid chamber and the pressure chamber is smaller than an inertance between the second coupling portion with the representative second common liquid chamber and the pressure chamber.

14. The liquid ejecting head according to claim 12, wherein the individual flow channel branches off to the second coupling portion and the nozzle at a branching point between the pressure chamber and the second coupling portion, and in the individual flow channel constituting the individual flow channel group between the representative first common liquid chamber and the representative second common liquid chamber, an inertance between the first coupling portion and the pressure chamber is smaller than an inertance between the second coupling portion and the branching point in the individual flow channel.

15. The liquid ejecting head according to claim 12, wherein

M is 2, N is 1, m is 2, and n is 1, and an electrode electrically coupled to the pressure generating element is disposed at a position overlapping the second common liquid chamber in a direction perpendicular to a nozzle surface at which the nozzle is formed.

16. A liquid ejecting head comprising:

a flow channel forming substrate that forms a plurality of individual flow channels each including a nozzle and a pressure chamber, M (M is an integer of 1 or more) first common liquid chambers, and N (N is an integer of 1 or more) second common liquid chambers; and a pressure generating element that causes a pressure change in a liquid in the pressure chamber, wherein at least one of the plurality of individual flow channels constitutes an individual flow channel group, and couples at least corresponding one of the M first common liquid chambers and at least corresponding one of the N second common liquid chambers, a representative first common liquid chamber, which is one of the M first common liquid chambers, is coupled to each of n (n is an integer of 1 or more and N or less) second common liquid chambers among the N second common liquid chambers via corresponding one of the individual flow channels constituting the individual flow channel group, a representative second common liquid chamber, which is one of the n second common liquid chambers, is coupled to each of m (m is an integer of 1 or more and M or less) first common liquid chambers including the representative first common liquid chamber among the M first common liquid chambers via corresponding one of the individual flow channels constituting the individual flow channel group, a compliance of the representative first common liquid chamber is larger than n/m times a compliance of the representative second common liquid chamber, and in the individual flow channel constituting the individual flow channel group between the representative first common liquid chamber and the representative second common liquid chamber, an inertance between a first coupling portion with the representative first common liquid chamber and the pressure chamber is smaller than an inertance between a second coupling portion with the representative second common liquid chamber and the pressure chamber.

* * * * *